US011352843B2

(12) United States Patent
Callaghan

(10) Patent No.: US 11,352,843 B2
(45) Date of Patent: Jun. 7, 2022

(54) SYSTEM AND METHOD FOR OFFLINE STANDBUILDING

(71) Applicant: NOV CANADA ULC, Calgary (CA)

(72) Inventor: Jonathan Douglas Callaghan, Edmonton (CA)

(73) Assignee: NOV CANADA ULC, Calgary (CA)

( * ) Notice: Subject to any disclaimer, the term of this patent is extended or adjusted under 35 U.S.C. 154(b) by 0 days.

(21) Appl. No.: 16/098,160

(22) PCT Filed: May 12, 2017

(86) PCT No.: PCT/CA2017/000125

§ 371 (c)(1),
(2) Date: Nov. 1, 2018

(87) PCT Pub. No.: WO2017/193204

PCT Pub. Date: Nov. 16, 2017

(65) Prior Publication Data

US 2019/0145197 A1 May 16, 2019

Related U.S. Application Data

(60) Provisional application No. 62/335,282, filed on May 12, 2016.

(51) Int. Cl.
*E21B 19/20* (2006.01)
*E21B 19/16* (2006.01)
(Continued)

(52) U.S. Cl.
CPC ..... *E21B 19/20* (2013.01); *E21B 19/00* (2013.01); *E21B 19/06* (2013.01); *E21B 19/14* (2013.01); *E21B 19/16* (2013.01); *E21B 19/161* (2013.01)

(58) Field of Classification Search
CPC ..... E21B 19/20; E21B 19/00; E21B 19/06; E21B 19/14; E21B 19/16; E21B 19/161
(Continued)

(56) References Cited

U.S. PATENT DOCUMENTS 1,818,278 A 8/1931 Siler
2,531,930 A 11/1950 Woolslayer et al.
(Continued)

FOREIGN PATENT DOCUMENTS

CA 2911388 A1 11/2014
CA 2855105 A1 12/2015
(Continued)

OTHER PUBLICATIONS

"International Application Serial No. PCT/CA2017/000125, International Preliminary Report on Patentability dated Nov. 22, 2018", 6 pgs.
(Continued)

*Primary Examiner* — Matthew Troutman
*Assistant Examiner* — Patrick F Lambe
(74) *Attorney, Agent, or Firm* — Schwegman Lundberg & Woessner, P.A.

(57) ABSTRACT

A drill rig having a drill pipe standbuilding system. The standbuilding system may have one or more offline mouseholes, such as two offline mouseholes, a hoist arranged on a rail system, and an iron roughneck. The rail system may be arranged on the mast, such as above a racking board. The hoist may extend from the rail system, through the racking board, and toward a drill floor of the drill rig. The offline mouseholes, rail system, hoist, and iron roughneck may allow drill pipe stands to be built without interrupting or slowing drilling operations. A method of standbuilding may include arranging a first pipe section in a first mousehole, arranging a second pipe section in a second mousehole,
(Continued)

coupling a third pipe section to the second pipe section to form a double stand, and coupling the second pipe section to the first pipe section to form a triple stand.

9 Claims, 18 Drawing Sheets

(51) Int. Cl.
*E21B 19/00* (2006.01)
*E21B 19/06* (2006.01)
*E21B 19/14* (2006.01)

(58) Field of Classification Search
USPC ..... 166/77.52
See application file for complete search history.

(56) References Cited

U.S. PATENT DOCUMENTS 2,615,681 A 10/1952 True
2,735,556 A 2/1956 Stone
2,885,096 A 5/1959 De Jarnett
2,946,464 A 7/1960 Guier
3,225,949 A 12/1965 Erickson et al.
3,272,365 A 9/1966 Stevens
3,533,516 A 10/1970 Guier
3,615,027 A 10/1971 Ham
3,747,789 A 7/1973 Shipley et al.
3,768,663 A 10/1973 Turner et al.
3,840,128 A 10/1974 Swoboda et al.
3,877,583 A 4/1975 Bokenkamp
3,921,823 A 11/1975 Bourree et al.
3,976,207 A 8/1976 Schultz
3,994,350 A 11/1976 Smith et al.
4,042,123 A 8/1977 Sheldon et al.
4,117,941 A 10/1978 Mccleskey, Jr. et al.
4,126,348 A 11/1978 Palmer
4,274,778 A 6/1981 Putnam et al.
4,289,442 A 9/1981 Stevens
4,348,920 A 9/1982 Boyadjieff
4,397,605 A 8/1983 Cowgill et al.
4,531,875 A 7/1985 Krueger
4,591,006 A 5/1986 Hutchison et al.
4,621,974 A 11/1986 Krueger
4,680,519 A 7/1987 Chand et al.
4,715,761 A 12/1987 Berry et al.
4,738,321 A 4/1988 Olivier
4,846,357 A 7/1989 Sholl et al.
4,899,095 A 2/1990 Kishi et al.
5,038,871 A 8/1991 Dinsdale
5,211,251 A 5/1993 Woolslayer
5,813,286 A 9/1998 Hansen
5,921,329 A 7/1999 Armstrong
6,047,771 A 4/2000 Roeynestad
6,260,646 B1 7/2001 Fernandez et al.
6,412,576 B1 * 7/2002 Meiners ..... E21B 15/00 175/170
7,137,616 B2 11/2006 Kysely
7,249,639 B2 7/2007 Belik
7,370,707 B2 5/2008 Mcdaniel et al.
7,726,929 B1 6/2010 Orgeron
7,905,311 B2 3/2011 Brown
7,946,795 B2 5/2011 Orgeron
7,984,757 B1 7/2011 Keast et al.
8,074,484 B2 12/2011 Denkmeier et al.
8,191,637 B2 6/2012 Havinga
8,210,269 B2 7/2012 Hudson et al.
8,317,448 B2 11/2012 Hankins et al.
8,504,206 B2 8/2013 Fudaba et al.
8,550,761 B2 10/2013 Belik et al.
8,690,508 B1 4/2014 Orgeron
9,291,010 B1 3/2016 Barnes
10,047,908 B1 8/2018 Bohle, II et al.
10,053,934 B2 8/2018 Keogh et al.
10,384,907 B2 8/2019 Upmeier et al.
10,794,126 B2 10/2020 Magnuson
10,995,564 B2 5/2021 Miller et al.
11,035,183 B2 6/2021 Donnally et al.
2003/0159854 A1 8/2003 Simpson et al.
2004/0057815 A1 3/2004 Woolslayer et al.
2005/0055132 A1 3/2005 Matsumoto et al.
2005/0113971 A1 5/2005 Zhang et al.
2005/0126792 A1 6/2005 Berry
2006/0081379 A1 4/2006 Fehres et al.
2006/0104747 A1 5/2006 Zahn et al.
2006/0124316 A1 6/2006 Pietras
2006/0231344 A1 10/2006 Drzewiecki
2006/0249292 A1 11/2006 Guidry
2007/0062705 A1 3/2007 Schats et al.
2007/0114069 A1 5/2007 Hooper et al.
2007/0228671 A1 10/2007 Norton
2008/0136203 A1 * 6/2008 Krijnen ..... E21B 19/20 294/91
2008/0202812 A1 * 8/2008 Childers ..... E21B 19/20 175/52
2008/0238095 A1 10/2008 Yater et al.
2008/0296065 A1 * 12/2008 Standal ..... E21B 19/14 175/52
2009/0283324 A1 11/2009 Konduc et al.
2010/0163247 A1 7/2010 Wright et al.
2010/0193198 A1 8/2010 Murray et al.
2010/0303586 A1 12/2010 Hankins et al.
2011/0079434 A1 4/2011 Belik et al.
2011/0120730 A1 5/2011 Clasen et al.
2011/0226485 A1 9/2011 Seneviratne et al.
2012/0018222 A1 1/2012 Hankins et al.
2012/0259337 A1 10/2012 Del Rio et al.
2013/0075114 A1 3/2013 Dekker et al.
2013/0142607 A1 6/2013 Ditzler
2014/0054089 A1 2/2014 Sondervik
2014/0097027 A1 4/2014 Marica et al.
2014/0145408 A1 5/2014 Midas et al.
2015/0053424 A1 2/2015 Wiens et al.
2015/0127152 A1 5/2015 Nammoto et al.
2015/0148952 A1 5/2015 Shiratsuchi
2015/0232272 A1 * 8/2015 Magnuson ..... E21B 19/14 700/217
2015/0272579 A1 10/2015 Leimbach et al.
2015/0273688 A1 10/2015 Harada et al.
2015/0275596 A1 10/2015 Hickie
2015/0283704 A1 10/2015 Watanabe
2015/0330162 A1 * 11/2015 Magnuson ..... E21B 19/14 414/22.68
2016/0060979 A1 * 3/2016 Magnuson ..... E21B 19/14 414/22.63
2016/0115745 A1 4/2016 Bisel
2016/0145954 A1 5/2016 Helms et al.
2016/0160586 A1 6/2016 Keogh et al.
2016/0201408 A1 7/2016 Little et al.
2017/0172295 A1 6/2017 Tropper
2017/0204687 A1 7/2017 Yorga et al.
2017/0232620 A1 8/2017 Kalb et al.
2017/0234088 A1 8/2017 Orr et al.
2018/0245408 A1 8/2018 Keogh et al.
2018/0328112 A1 11/2018 Berry et al.
2018/0334865 A1 11/2018 Miller et al.
2019/0017334 A1 1/2019 Loeyning et al.
2019/0143532 A1 5/2019 Cutkosky et al.
2019/0309585 A1 10/2019 Miller et al.
2019/0352982 A1 11/2019 Arefi et al.
2020/0032597 A1 1/2020 Jorgic et al.
2020/0040673 A1 2/2020 Donnally et al.
2020/0040674 A1 2/2020 Mckenzie et al.
2021/0246738 A1 8/2021 Mckenzie et al.
2021/0293099 A1 9/2021 Carnegie et al.
2021/0301602 A1 9/2021 Mckenzie et al.

FOREIGN PATENT DOCUMENTS

CN 108266139 A 7/2018
CN 110792399 A 2/2020
EP 1953334 A2 8/2008
GB 2091788 A 8/1982

(56) References Cited

FOREIGN PATENT DOCUMENTS

| | | | |
|---|---|---|---|
| GB | 2532267 | A | 5/2016 |
| JP | H09-137689 | A | 5/1997 |
| NO | 20151648 | A1 | 12/2015 |
| WO | WO-8800274 | A2 | 1/1988 |
| WO | WO-9958811 | A1 | 11/1999 |
| WO | WO-0123701 | A1 | 4/2001 |
| WO | WO-2004018829 | A1 | 3/2004 |
| WO | WO-2013082172 | A1 | 6/2013 |
| WO | WO-2014179730 | A1 | 11/2014 |
| WO | WO-2015/043740 | A1 | 4/2015 |
| WO | WO-2016024859 | A1 | 2/2016 |
| WO | WO-2016197255 | A1 | 12/2016 |
| WO | WO-2017039996 | A1 | 3/2017 |
| WO | WO-2017087595 | A1 | 5/2017 |
| WO | WO-2017190120 | A1 | 11/2017 |
| WO | WO-2017193204 | A1 | 11/2017 |
| WO | WO-2019195651 | A1 | 10/2019 |
| WO | WO-2020/028853 | A9 | 2/2020 |
| WO | WO-2020028852 | A1 | 2/2020 |
| WO | WO-2020028853 | A1 | 2/2020 |
| WO | WO-2020028856 | A1 | 2/2020 |
| WO | WO-2020028858 | A1 | 2/2020 |
| WO | WO-2020151386 | A1 | 7/2020 |
| WO | WO-2020172407 | A1 | 8/2020 |
| WO | WO-2021/203122 | A1 | 10/2021 |
| WO | WO-2021/226622 | A1 | 11/2021 |

OTHER PUBLICATIONS

"International Application Serial No. PCT/CA2017/000125, International Search Report dated Aug. 14, 2017", 3 pgs.
"International Application Serial No. PCT/CA2017/000125, Written Opinion dated Aug. 14, 2017", 4 pgs.
"U.S. Appl. No. 16/375,927, Advisory Action dated Aug. 11, 2020", 6 pgs.
"U.S. Appl. No. 16/375,927, Examiner Interview Summary dated Apr. 24, 2020", 3 pgs.
"U.S. Appl. No. 16/375,927, Final Office Action dated Jun. 5, 2020", 10 pgs.
"U.S. Appl. No. 16/375,927, Non Final Office Action dated Feb. 28, 2020", 9 pgs.
"U.S. Appl. No. 16/375,927, Response filed May 27, 2020 to Non Final Office Action dated Feb. 28, 2020", 10 pgs.
"U.S. Appl. No. 16/375,927, Response filed Aug. 3, 2020 to Final Office Action dated Jun. 5, 2020", 11 pgs.
"U.S. Appl. No. 16/431,540, Non Final Office Action dated Jun. 10, 2020", 13 pgs.
"Canadian Application Serial No. 3,022,888, Voluntary Amendment filed Jul. 12, 2019", 10 pgs.
"International Application Serial No. PCT/CN2019/124443, International Search Report dated Mar. 5, 2020", 4 pgs.
"International Application Serial No. PCT/CN2019/124443, Written Opinion dated Mar. 5, 2020", 4 pgs.
"International Application Serial No. PCT/US2019/025942, International Search Report dated Jun. 27, 2019", 4 pgs.
"International Application Serial No. PCT/US2019/025942, Response filed Feb. 5, 2020 to Written Opinion dated Feb. 27, 2019", 14 pgs.
"International Application Serial No. PCT/US2019/025942, Response filed Apr. 23, 2020 to Written Opinion dated Apr. 23, 2020", 14 pgs.
"International Application Serial No. PCT/US2019/025942, Written Opinion dated Feb. 24, 2020", 8 pgs.
"International Application Serial No. PCT/US2019/025942, Written Opinion dated Jun. 27, 2019", 9 pgs.
"International Application Serial No. PCT/US2019/025942, Written Opinion dated Jul. 23, 2020", 5 pgs.
"International Application Serial No. PCT/US2019/044974, International Search Report dated Oct. 24, 2019", 6 pgs.
"International Application Serial No. PCT/US2019/044974, Response filed Jun. 2, 2020 to Written Opinion dated Oct. 24, 2019", 13 pgs.
"International Application Serial No. PCT/US2019/044974, Response filed Aug. 18, 2020 to Written Opinion dated Jun. 19, 2020", 4 pgs.
"International Application Serial No. PCT/US2019/044974, Written Opinion dated Jun. 19, 2020", 7 pgs.
"International Application Serial No. PCT/US2019/044974, Written Opinion dated Oct. 24, 2019", 6 pgs.
"International Application Serial No. PCT/US2019/044976, International Search Report dated Oct. 18, 2019", 5 pgs.
"International Application Serial No. PCT/US2019/044976, Response filed Jun. 3, 2020 to Written Opinion dated Oct. 18, 2019", 11 pgs.
"International Application Serial No. PCT/US2019/044976, Response filed Aug. 25, 2020 to Written Opinion dated Jun. 26, 2020", 3 pgs.
"International Application Serial No. PCT/US2019/044976, Written Opinion dated Jun. 26, 2020", 4 pgs.
"International Application Serial No. PCT/US2019/044976, Written Opinion dated Oct. 18, 2019", 8 pgs.
"International Application Serial No. PCT/US2019/044979, International Search Report dated Oct. 22, 2019", 6 pgs.
"International Application Serial No. PCT/US2019/044979, Response filed Jun. 3, 2020 to Written Opinion dated Oct. 22, 2019", 12 pgs.
"International Application Serial No. PCT/US2019/044979, Response filed Aug. 25, 2020 to Written Opinion dated Jun. 26, 2020", 3 pgs.
"International Application Serial No. PCT/US2019/044979, Written Opinion dated Jun. 26, 2020", 4 pgs.
"International Application Serial No. PCT/US2019/044979, Written Opinion dated Oct. 22, 2019", 7 pgs.
"International Application Serial No. PCT/US2019/044983, International Search Report dated Oct. 22, 2019", 5 pgs.
"International Application Serial No. PCT/US2019/044983, Written Opinion dated Oct. 22, 2019", 6 pgs.
"International Application Serial No. PCT/US2020/019039, International Search Report dated May 15, 2020", 2 pgs.
"International Application Serial No. PCT/US2020/019039, Written Opinion dated May 15, 2020", 4 pgs.
"U.S. Appl. No. 16/375,927, Corrected Notice of Allowability dated Jan. 26, 2021", 2 pgs.
"U.S. Appl. No. 16/431,540, Examiner Interview Summary dated Jan. 19, 2021", 3 pgs.
"U.S. Appl. No. 16/431,540, Notice of Allowance dated Feb. 11, 2021", 5 pgs.
"U.S. Appl. No. 16/431,540, Response filed Jan. 19, 2021 to Final Office Action dated Nov. 19, 2020", 11 pgs.
"U.S. Appl. No. 16/431,540, Supplemental Notice of Allowability dated Mar. 11, 2021", 2 pgs.
"U.S. Appl. No. 16/836,365, Non Final Office Action dated Jan. 25, 2021", 8 pgs.
"International Application Serial No. PCT/US2019/044983, International Preliminary Report on Patentability dated Feb. 18, 2021", 8 pgs.
"U.S. Appl. No. 16/375,927, Examiner Interview Summary dated Dec. 7, 2020", 7 pgs.
"U.S. Appl. No. 16/375,927, Non Final Office Action dated Sep. 24, 2020", 10 pgs.
"U.S. Appl. No. 16/375,927, Notice of Allowance dated Jan. 1, 2021", 8 pgs.
"U.S. Appl. No. 16/375,927, Response filed Sep. 8, 2020 to Advisory Action dated Aug. 11, 2020", 10 pgs.
"U.S. Appl. No. 16/375,927, Response filed Dec. 16, 2020 to Non Final Office Action dated Sep. 24, 2020", 8 pgs.
"U.S. Appl. No. 16/431,540, Final Office Action dated Nov. 19, 2020", 10 pgs.
"U.S. Appl. No. 16/431,540, Response Filed Sep. 10, 2020 to Non Final Office Action dated Jun. 10, 2020", 24 pgs.
"International Application Serial No. PCT/US2019/025942, International Preliminary Report on Patentability dated Oct. 30, 2020", 7 pgs.
"International Application Serial No. PCT/US2019/025942, Response filed Sep. 22, 2020 to Written Opinion dated Jul. 23, 2020", 4 pgs.
"International Application Serial No. PCT/US2019/044974, International Preliminary Report on Patentability dated Nov. 11, 2020", 7 pgs.
"International Application Serial No. PCT/US2019/044976, Written Opinion dated Nov. 6, 2020", 6 pgs.

(56) References Cited

OTHER PUBLICATIONS

"International Application Serial No. PCT/US2019/044979, International Preliminary Report on Patentability dated Nov. 18, 2020", 7 pgs.
"International Application Serial No. PCT/US2019/124443, Response filed Nov. 24, 2020 to Written Opinion dated Mar. 5, 2020", 10 pgs.
"U.S. Appl. No. 16/836,365, Final Office Action dated May 4, 2021", 7 pgs.
"U.S. Appl. No. 16/836,365, Notice of Allowance dated Jul. 27, 2021", 7 pgs.
"U.S. Appl. No. 16/836,365, Response filed Apr. 22, 2021 to Non Final Office Action dated Jan. 25, 2021", 8 pgs.
"U.S. Appl. No. 16/836,365, Response filed Jul. 2, 2021 to Final Office Action dated May 4, 2021", 7 pgs.
"International Application Serial No. PCT/CN2019/124443, International Preliminary Report on Patentability dated May 26, 2021", 4 pgs.
"International Application Serial No. PCT/US2021/070319, International Search Report dated May 31, 2021", 5 pgs.
"International Application Serial No. PCT/US2021/070319, Written Opinion dated May 31, 2021", 6 pgs.
"International Application Serial No. PCT/US2021/070488, Invitation to Pay Additional Fees dated Jun. 28, 2021", 2 pgs.
"Moveit—Kinematic constraints: Visibility Constraint Class Reference", [online]. [retrieved Apr. 21, 2021]. Retrieved from the Internet: <URL: http://docs.ros.org/en/hydro/api/moveit_core/html/classkinematic__constraints_1_1VisibilityConstraint.html>, (2021), 8 pgs.
"Moveit—Moving robots into the future", [online]. [archived Dec. 4, 2020]. Retrieved from the Internet: <URL: https://web.archive.org/web/20201204224545/https://moveit.ros.org/>, (2020), 7 pgs.
"U.S. Appl. No. 16/836,365, Notice of Allowance dated Nov. 3, 2021", 7 pgs.
"U.S. Appl. No. 17/248,669, Examiner Interview Summary dated Dec. 17, 2021", 2 pgs.
"U.S. Appl. No. 17/248,669, Non-Final Office Action dated Oct. 5, 2021", 8 pgs.
"International Application Serial No. PCT/US2020/019039, International Preliminary Report on Patentability dated Sep. 2, 2021", 6 pgs.
"International Application Serial No. PCT/US2021/070488, International Search Report dated Sep. 8, 2021", 4 pgs.
"International Application Serial No. PCT/US2021/070488, Written Opinion dated Sep. 8, 2021", 6 pgs.
"International Application Serial No. PCT/US2021/070786, International Search Report dated Nov. 9, 2021", 4 pgs.
"International Application Serial No. PCT/US2021/070786, Invitation to Pay Additional Fees dated Sep. 1, 2021", 2 pgs.
"International Application Serial No. PCT/US2021/070786, Written Opinion dated Nov. 9, 2021", 7 pgs.
U.S. Appl. No. 17/310,672, filed Aug. 17, 2021, Dual Activity Top Drive.
U.S. Appl. No. 17/250,548, filed Feb. 2, 2021, End Effectors for Automated Pipe Handling.
U.S. Appl. No. 17/248,669, filed Feb. 2, 2021, Robot End-Effector Orientation Contstraint for Pipe Tailing Path.
U.S. Appl. No. 16/375,927, filed Apr. 5, 2019, System for Handling Tubulars on a Rig.
U.S. Appl. No. 16/431,533, filed Jun. 4, 2019, Devices, Systems, and Methods for Robotic Pipe Handling.
U.S. Appl. No. 16/836,365, filed Mar. 31, 2020, Robotic Pipe Handling From Outside a Setback Area.
U.S. Appl. No. 16/431,540, filed Jun. 4, 2019, Devices, Systems, and Methods for Top Drive Clearing.
U.S. Appl. No. 16/786,345, filed Feb. 10, 2020, Quick Coupling Drill Pipe Connector.

* cited by examiner

SYSTEM AND METHOD FOR OFFLINE STANDBUILDING

CROSS-REFERENCE TO RELATED APPLICATIONS

This application claims priority to U.S. Provisional Application No. 62/335,282, filed May 12, 2016, which is hereby incorporated by reference herein in its entirety.

FIELD OF THE INVENTION

The present disclosure relates to oil well drill rigs. Particularly, the present disclosure relates to drill pipe standbuilding for drill strings. More particularly, the present disclosure relates to systems and methods for offline drill pipe standbuilding for land-based oil drill rigs.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Land-based and offshore drilling operations, such as oil drilling operations, typically include the use of a drill string driven by a top drive. The drill string may include a drill bit and a plurality of drill pipe joints or lengths. As the well deepens, more lengths of drill pipe may be added to the drill string. The process of connecting each length of drill pipe to the drill string can be time-consuming. Accordingly, in some drilling operations, lengths of drill pipe are connected into double or triple stands prior to being added to the drill string, such that a longer length of pipe may be added to the drill string at once. The process of connecting single joints of drill pipe into multi joint stands is often referred to as standbuilding. Each length of drill pipe may have a length of approximately 30 feet, such that a double stand may have a length of approximately 60 feet, and a triple stand may have a length of approximately 90 feet. Theses double or triple stands may be connected in the wellbore to form the drill string. The drill string may then be connected to a top drive and may operate to drill the well. Relatively long sections of drill pipe may be desirable for tripping operations or for other purposes.

In many cases, double and triple drill pipe stands are assembled on the drill floor of the drill rig and prior to the start of drilling operations. Standbuilding can be time-consuming, and thus may add a significant amount of time to setup prior to the start of drilling operations. Typically, offline standbuilding operations are reserved for offshore drill rigs. Land-based rigs often have more limited drill floor space

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a drill rig having a drill floor for performing drilling operations, and an offline standbuilding system for building drill pipe stands without interrupting drilling operations. The offline standbuilding system may include a hoist, a rail system supporting the hoist, and an offline mousehole. In some embodiments, the offline mousehole may be a first offline mousehole, and the standbuilding system may have a second offline mousehole. The rig may have a mast in some embodiments, and the rail system may extend laterally from the mast. The rail system may have a pair of rails and a bridge extending between the rails. The bridge may be configured to move along the rails. Moreover, the hoist may be arranged on the bridge and may be configured to move along the bridge. In some embodiments, the hoist may include a hydraulic hoist, a wireline, and/or a pipe sling or pipe elevator. In some embodiments, the pipe sling or pipe elevator may be configured to hoist two drill pipe sections simultaneously. In some embodiments, the drill rig may have an iron roughneck arranged on the drill floor for coupling drill pipe sections together to form drill pipe stands. Additionally, in some embodiments, the drill rig may be a land rig.

The present disclosure, in one or more other embodiments, relates to an offline standbuilding system for building drill pipe stands without interrupting drilling operations. The system may include a hoist, a rail system supporting the hoist, and an offline mousehole. In some embodiments, the offline mousehole may be a first mousehole, and the standbuilding system may further have a second offline mousehole. In some embodiments, the rail system may extend laterally from a drill rig mast. The rail system may include a pair of rails and a bridge extending between the rails. The bridge may be configured to move along the rails. Moreover, the hoist may be arranged on the bridge and may be configured to move along the bridge. The hoist may include a wireline and a pipe sling or pipe elevator. In some embodiments, the standbuilding system may additionally include an iron roughneck for coupling drill pipe sections together to form drill pipe stands.

The present disclosure, in one or more other embodiments, relates to a method for offline standbuilding. The method may include the steps of arranging a first drill pipe section in a first mousehole; arranging a second drill pipe section in a second mousehole; aligning a third drill pipe section with the second drill pipe section; coupling the third and second drill pipe sections together to form a double stand; aligning the double stand with the first drill pipe section; and coupling the double stand the first drill pipe section together to form a triple stand. In some embodiments, the steps of arranging the first drill pipe section in the first mousehole and arranging the second drill pipe section in the second mousehole may be performed simultaneously with a hoist. Moreover, the method may be performed during drilling operations in some embodiments.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to a drill rig having a drill pipe standbuilding system. The standbuilding system may have one or more offline mouseholes, such as two offline mouseholes, a hoist arranged on a rail system, and an iron roughneck. The rail system may be arranged on the mast, such as above a racking board. The hoist may extend from the rail system, through the racking board, and toward a drill floor of the drill rig. The offline mouseholes, rail system, hoist, and iron roughneck may allow drill pipe stands to be built without interrupting or slowing drilling operations. The present disclosure additionally relates to a method of standbuilding. The method may include arranging a first pipe section in a first mousehole, arranging a second pipe section in a second mousehole, coupling a third pipe section to the second pipe section to form a double stand, and coupling the second pipe section to the first pipe section to form a triple stand.

Figure 1:
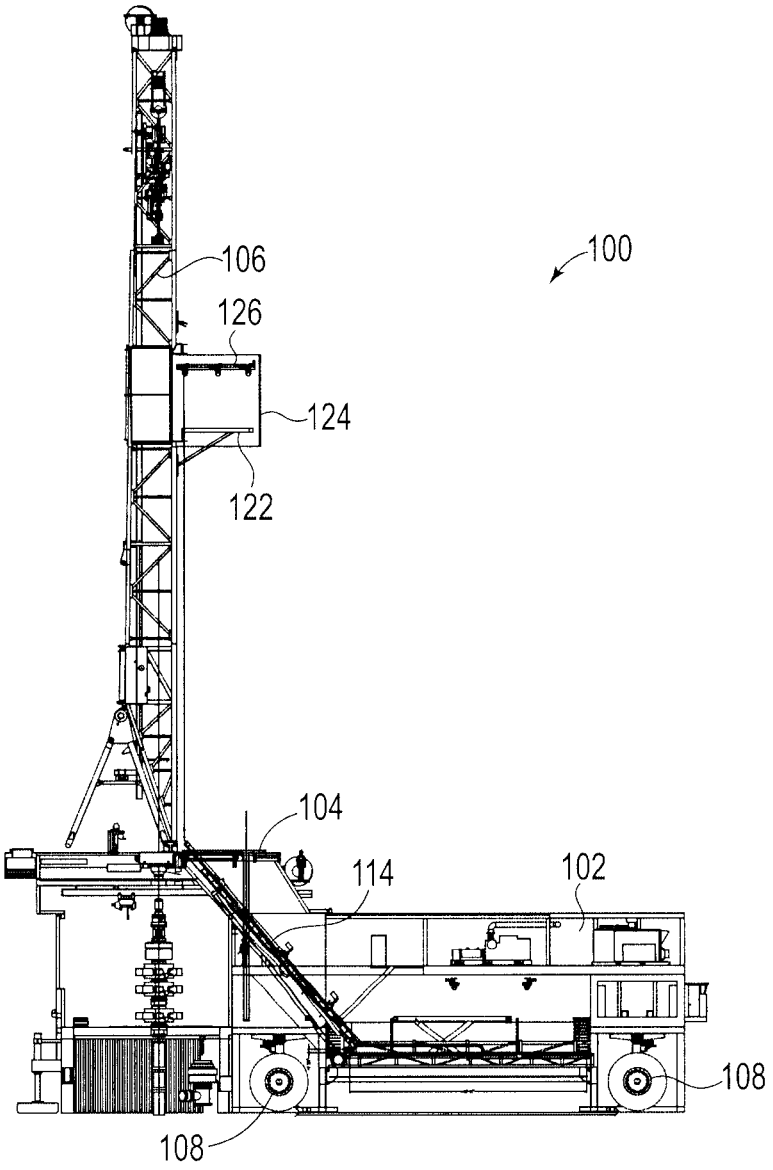
FIG. 1 is a side view of a drill rig of the present disclosure, according to one or more embodiments.

Turning now to FIG. 1, a drill rig 100 of the present disclosure is shown, according to one or more embodiments. The drill rig 100 may be configured for onshore oil drilling in some embodiments. However, in other embodiments, other drill rigs of the present disclosure may be configured for other drilling operations, including offshore drilling operations. The drill rig 100 may generally have a substructure 102 supporting a drill floor 104 and a mast 106. The drill rig 100 may be a mobile or stationary rig. In some embodiments, the drill rig 100 may have, for example, tires 108 or other moving means such as, but not limited to, walking feet or rails. In some embodiments, the rig 100 may be a drivable or towable rig.

The substructure 102 may be configured to support the drill floor 104 and mast 106. The substructure 102 may comprise a plurality of housings or boxes for housing equipment and/or storing various types of equipment.

The drill floor 104 may be arranged over the substructure 102 and may be configured to provide a platform for drilling operations. As shown for example in FIGS. 2 and 3, the drill floor 104 may generally provide a well center 110 opening through which a wellbore may be reached. In some embodiments, the drill floor 104 may have another opening, such as but not limited to a V-door 112, through which sections of drill pipe may be passed or raised onto the drill floor. In some embodiments, a ramp and/or pipe machine 114 may be arranged beneath the V-door 112 or other opening to facilitate movement of drill pipe sections to the drill floor 104, as shown in FIG. 1. In some embodiments, the drill floor 104 may additionally have one or more mouseholes 116, 118. For example, in some embodiments, the drill floor 104 may have two mouseholes 116, 118. In other embodiments, the drill floor 104 may have one, three, or any other suitable number of mouseholes 116, 118.

Each mousehole 116, 118 may be configured to provide a holder or casing configured to receive a section of drill pipe. Particularly, a mousehole 116, 118 may be configured to position a section of drill pipe on end with its longitudinal axis vertical. Additionally, the casing or holder of the mousehole 116, 118 may be arranged beneath an opening in the drill floor 104, such when placed in the mousehole, a majority of a pipe section is arranged beneath the drill floor. The casing or holder of the mousehole 116, 118 may have a cylindrical, square, or other suitable shape, and may have a closed or capped bottom end for supporting a section of drill pipe inserted in the mousehole. A mousehole 116, 118 may have a diameter or width configured to receive a diameter or width of a drill pipe section. Additionally, a mousehole 116, 118 may have a length or depth configured to receive a section of drill pipe, such that an end of the drill pipe may remain exposed above the drill floor 104 for connecting to a next drill pipe section. For example, in some embodiments, a mousehole 116, 118 may have a depth that is slightly shorter than the length of a drill pipe section. For example, where a drill pipe section has a length of approximately 30 feet, a mousehole 116, 118 may have a depth of between approximately 20 and 30 feet, or more particularly between approximately 22 and 29 feet, or more particularly between approximately 25 and 28 feet. In this way, the mousehole 116, 118 may be configured such that less than about 10 feet of a drill pipe section arranged in the mousehole remain exposed above the drill floor 104, or more particularly between about 1 and 8 feet, or more particularly between about 2 and 5 feet.

Figure 2:
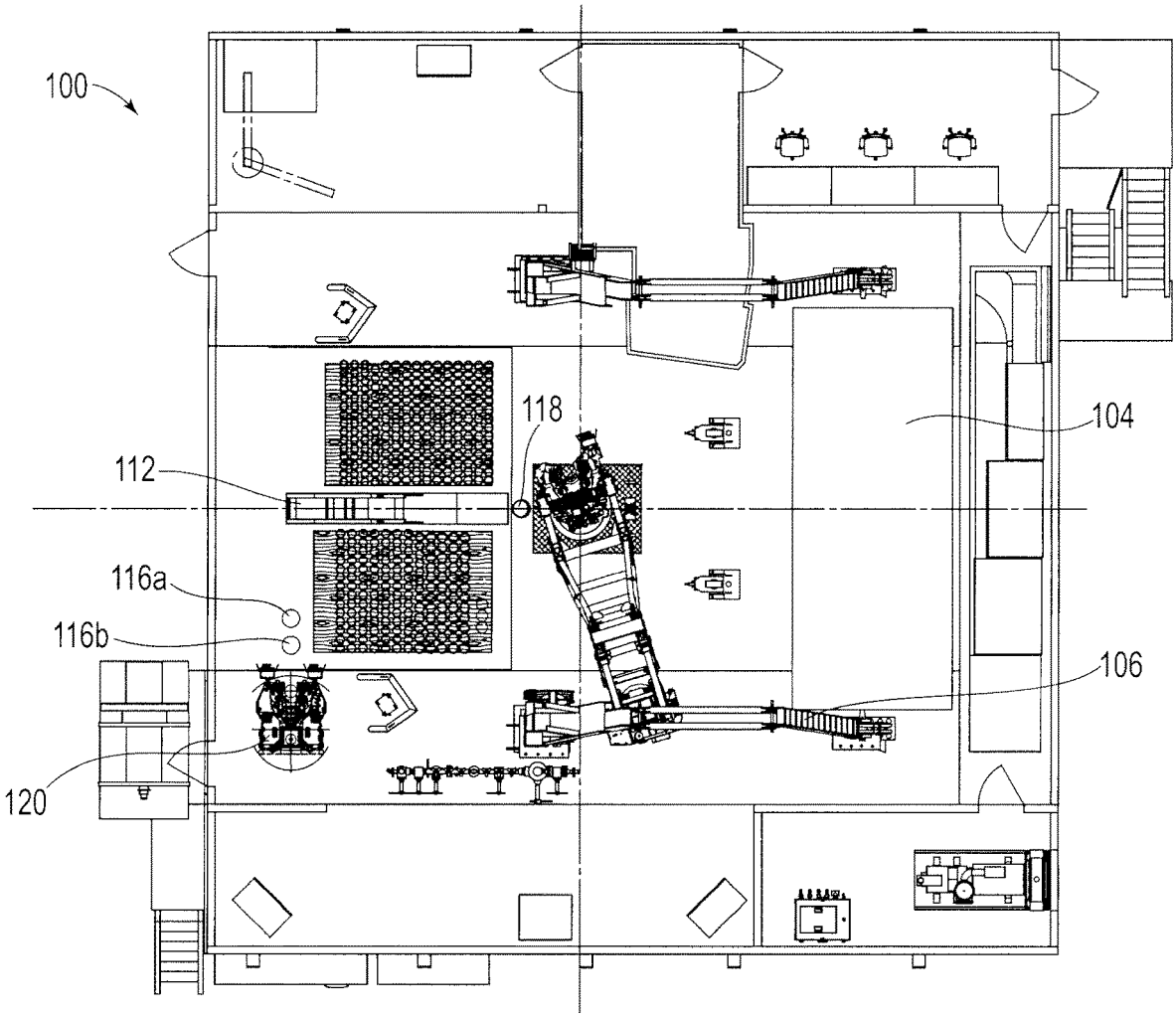
FIG. 2 is a plan view of a drill floor of a drill rig of the present disclosure, according to one or more embodiments.

As shown in FIG. 2, in some embodiments, one or more "offline" mouseholes 116*a*, 116*b* may be arranged at a location on the drill floor 104 toward an off-driller side of the drill floor. The one or more offline mouseholes 116 may be arranged at or near a setback area of the drill floor 104, for example, and may be off-center from the well center 110 in some embodiments. Moreover, the one or more offline mouseholes 116 may be arranged near the V-door 112. In some embodiments, the one or more offline mouseholes 116 may be arranged beneath or near a racking board 122 of the mast 106, as further described below. In some embodiments, one or more mouseholes 118 may additionally or alternatively be arranged near the well center 110 of the drill floor 104. For example, one or more mouseholes 118 may be arranged between the well center 110 and the V-door 112 in some embodiments, and may be aligned with the well center of the drill floor 104. In other embodiments, other mouseholes 116, 118 may be arranged in any other suitable drill floor 104 locations.

Figure 3:
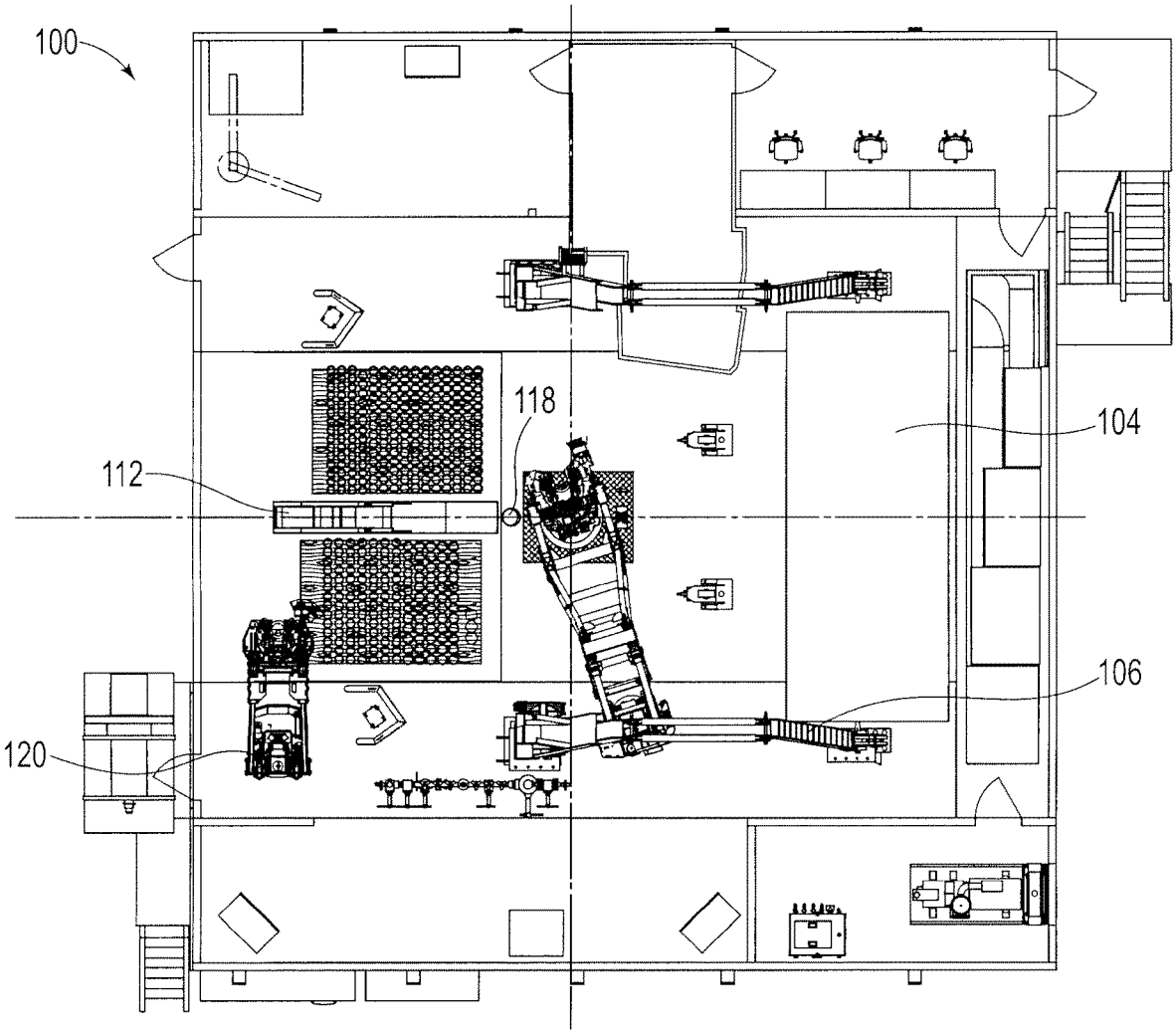
FIG. 3 is another plan view of the drill floor of FIG. 2, according to one or more embodiments.

The drill floor 104 may support a variety of equipment including, for example, one or more iron roughnecks. For example, an iron roughneck 120 may be arranged on an off-driller side of the drill floor 104, and may be configured to reach drill pipe sections arranged in one or more offline mouseholes 116, as shown in FIGS. 2 and 3. The iron roughneck 120 may be configured to couple sections of drill pipe together to form stands. The iron roughneck 120 may be provided in addition to a primary iron roughneck used for drilling operations.

Figure 4:
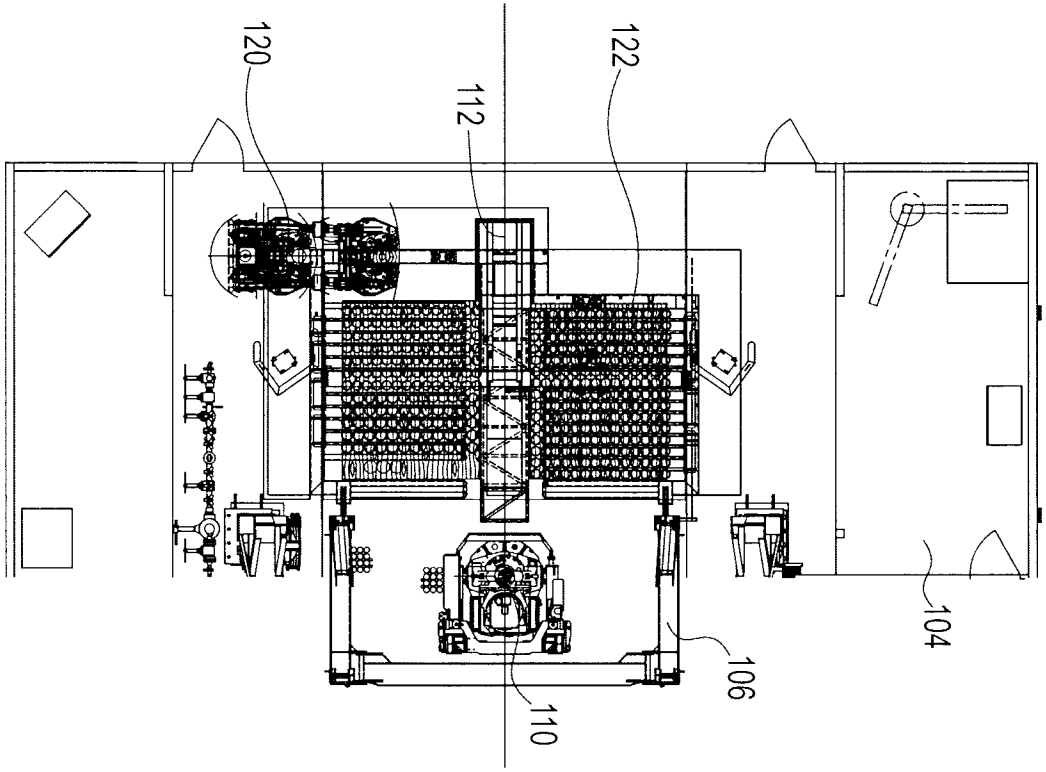
FIG. 4 is a plan view of a portion of a drill floor and racking board of a drill rig of the present disclosure, according to one or more embodiments.

Referring back to FIG. 1, the mast 106 may be configured to support a handling or lifting system having a cable or line reeved through, for example, a crown block and traveling block. The mast 106 and handling system may generally support a drill for drilling the well. Moreover, the mast 106 and handling system may be configured to facilitate adding drill pipe sections to a drill string. In some embodiments, the mast 106 may have a racking board 122. The racking board 122 may be configured to vertically rack sections of drilling pipe for use in drilling operations. The racking board may extend laterally from the mast 106, and may extend out over a portion of the drill floor 104, as shown for example in the plan view of FIG. 4. In some embodiments the racking board 122 may be arranged on the mast at a height of between approximately 40 and 150 feet. Particularly, the racking board 122 may be arranged at a height of between approximately 60 and 125 feet. More particularly, the racking board 122 may be arranged at a height of between approximately 80 and 100 feet. The racking board 122 may generally have a height configured to accommodate double or triple stands of drilling pipe extending vertically from the drill floor 104 to and through the racking board. In some embodiments, the mast 106 may additionally have a windwall 124. For example, the windwall 124 may be arranged around at least a portion of the racking board 122 so as to provide a protective barrier against wind and/or other elements.

In some embodiments, the racking board 122 may have a length extending from the mast 106 configured to accommodate the one or more offline mouseholes 116 on the drill floor 104. For example, as shown in FIG. 5, at least a portion of the racking board 122 length may extend outward from the mast 106 far enough to allow through access to the offline mouseholes 116 arranged below.

Figure 5:
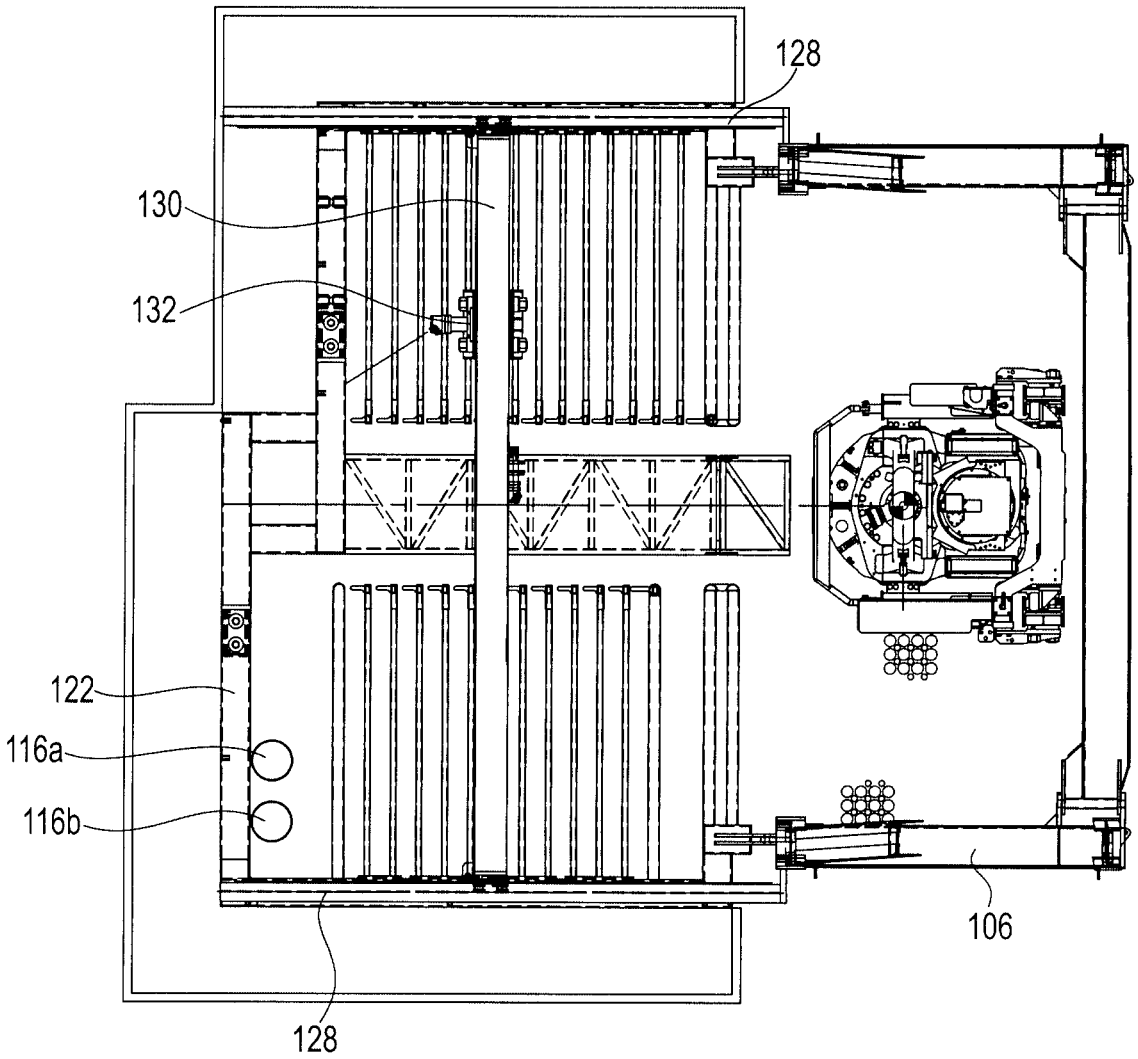
FIG. 5 is a plan view of a portion of a mast, racking board, and rail system of a drill rig of the present disclosure, according to one or more embodiments.
Figure 6:
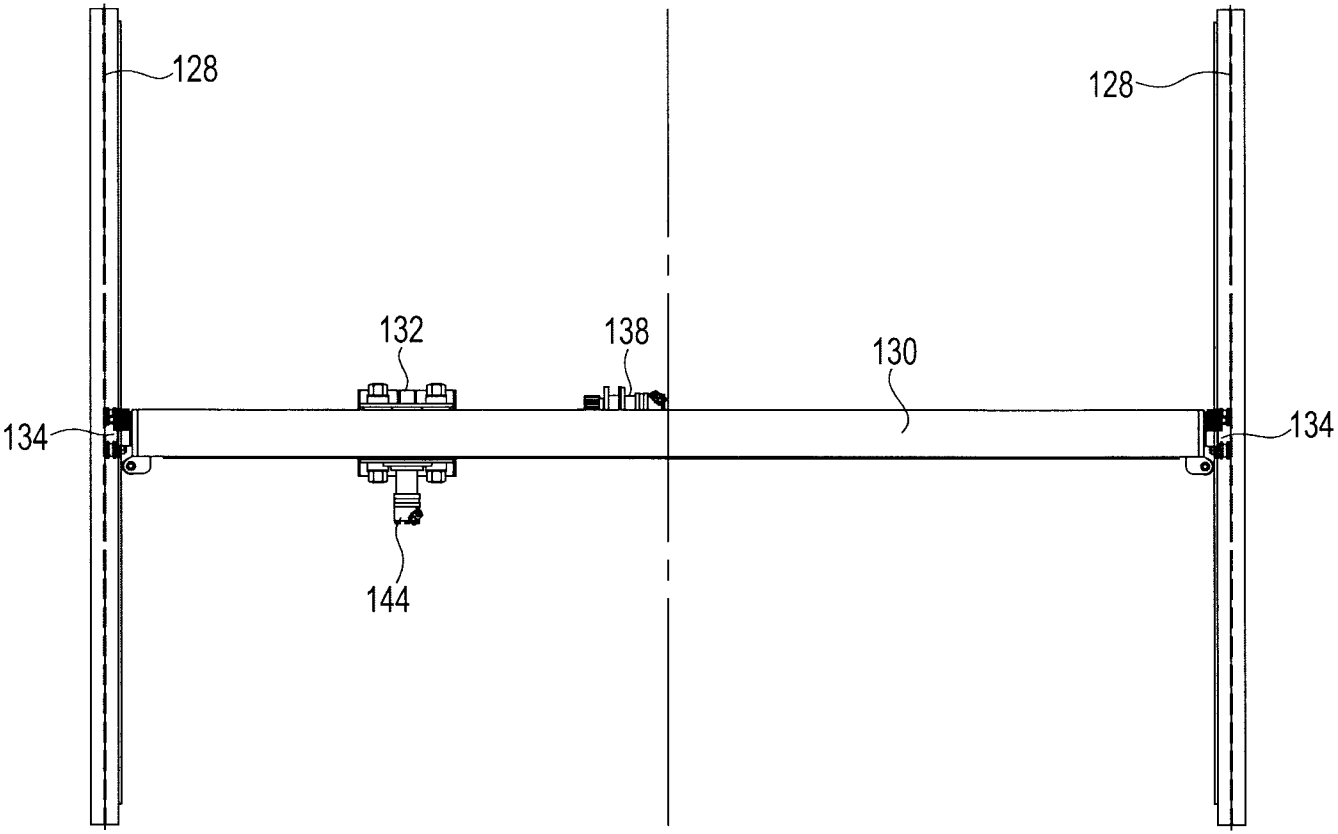
FIG. 6 is a plan view of a rail system of the present disclosure, according to one or more embodiments.

As shown in FIGS. 1 and 5, in some embodiments, the mast 106 may additionally have a rail system 126. The rail system 126 may be configured to provide handling operations for sections of drill pipe. For example, the rail system 126 may provide handling operations whereby sections of pipe may be inserted into one or more of the mouseholes 116, 118, aligned with one another for coupling, brought to the racking board 122, and/or otherwise manipulated. In some embodiments, the rail system 126 may be arranged on the mast 106 at a height above the racking board 122. That is, the rail system 126 may be arranged above the racking board 122, and may extend across the racking board to manipulate drill pipe sections on the drill floor 104. In some embodiments, the rail system 126 may be arranged at a height of between approximately 55 feet and 175 feet. In some embodiments, the rail system 126 may be arranged at a height of between approximately 80 feet and 150 feet. Particularly, the rail system 126 may be arranged at a height of between approximately 110 feet and 120 feet in some embodiments. In other embodiments, the rail system 126 may be incorporated into or coupled to the racking board 122, windwall 124, or any other suitable structure. As shown in FIGS. 5 and 6, in some embodiments, the rail system 126 may include a pair of rails 128, a bridge 130 extending between the rails, and a hoist 132.

The two rails 128 may parallel one another and may generally extend outward from the mast 106, such as above the racking board 122. The rails 128 may be configured to support the bridge 130 and hoist 132, and may generally allow the bridge and/or hoist to move laterally toward and away from the mast 106. For example, the bridge 130 may extend between the two rails 128 and may generally slide along the two rails, laterally toward and away from the mast 106. In this way, each rail 128 may provide a track along which the bridge 130 may move. In some embodiments, each rail 128 may have a gear rack configured to engage with one or more gears or a gear box of the bridge 130. In other embodiments, the rails 128 may engage with the bridge 130 with other suitable mechanisms. In some embodiments, the rails 128 may be arranged parallel to one another along the mast 106 such that a first rail is located near an off-driller side, and a second rail is arranged near a driller side. In some embodiments, the rails 128 may be welded, bolted, pinned, or otherwise secured to the mast 106 or another structure. In some embodiments, the rails 128 may have a length extending from the mast 106 sufficient to allow the hoist to reach the offline mouseholes 116. As shown for example in FIG. 5, the rails 128 may have a length extending from the mast 106 such that the bridge 130 may be arranged over the mouseholes 116.

Figure 7:
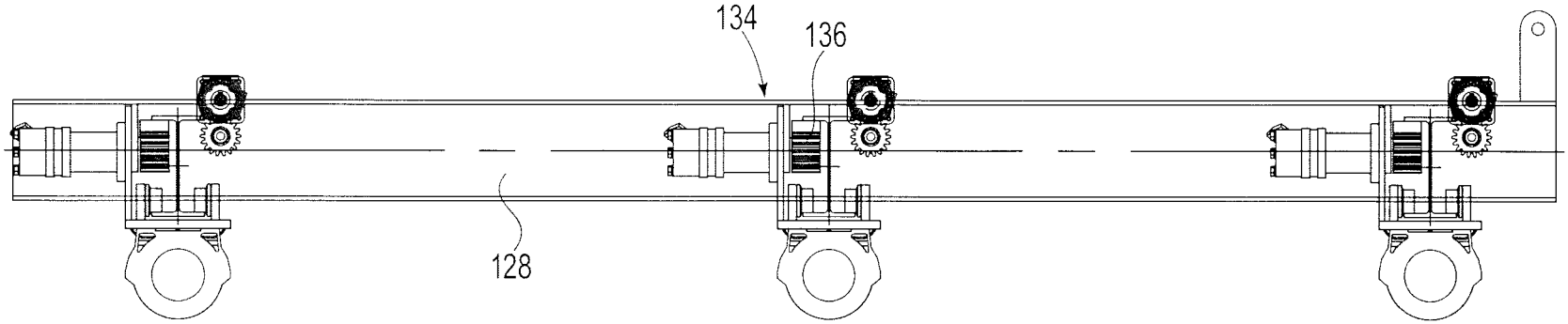
FIG. 7 is a side view of a rail system of the present disclosure, according to one or more embodiments.
Figure 8:
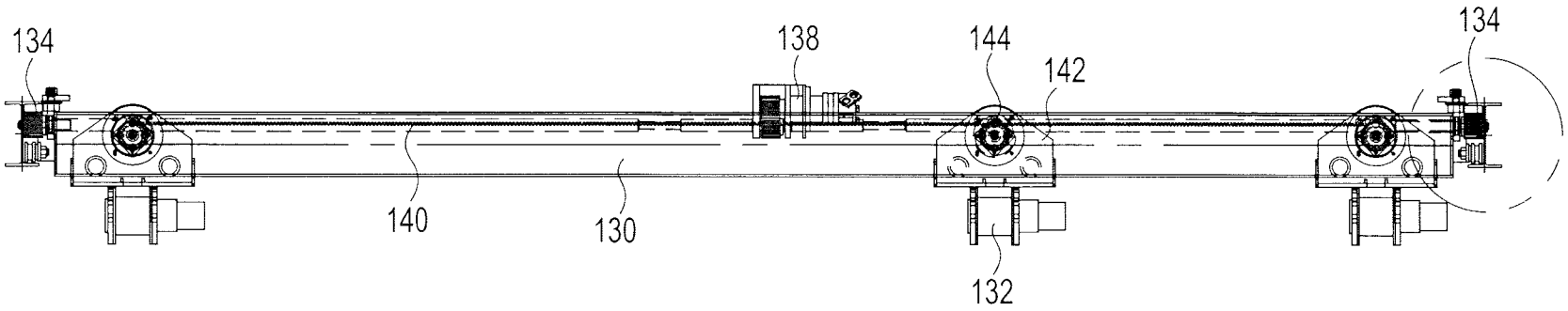
FIG. 8 is a side view of a bridge of a rail system of the present disclosure, according to one or more embodiments.
Figure 9:
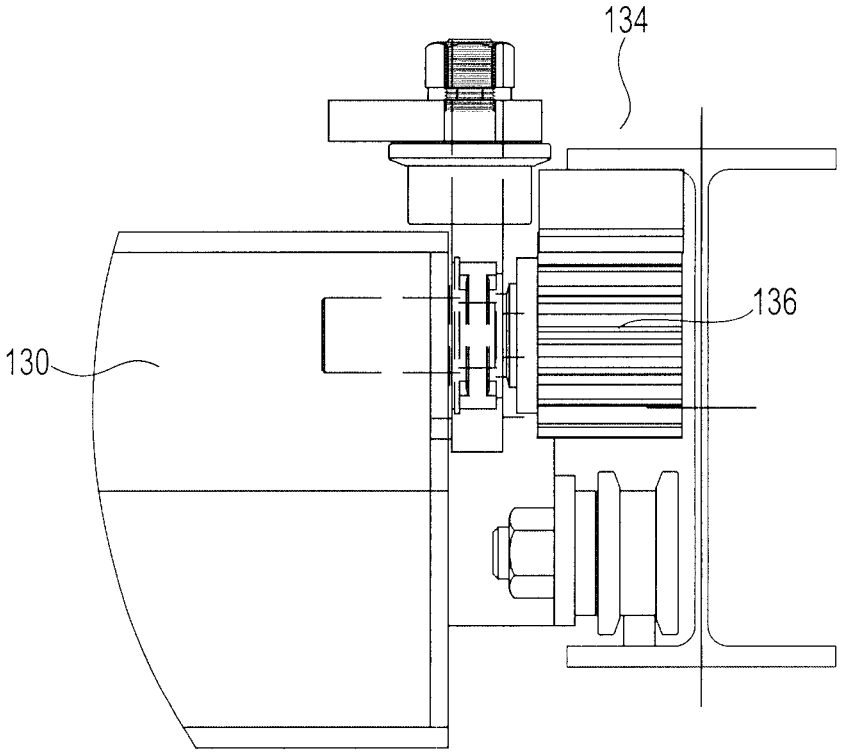
FIG. 9 is an isolation view of an engagement mechanism of a rail system of the present disclosure, according to one or more embodiments.

The bridge 130 may span between the two rails 128 and may be configured to support the hoist 132. The bridge 130 may additionally be configured to slide or move along the two rails 128, such as to move the hoist 132 toward and away from the mast 106. In some embodiments, the bridge 130 may have an engagement mechanism 134 at each end configured to engage with the rails 128. An engagement mechanism 134 is shown in FIG. 9, for example. As shown, the engagement mechanism 134 may have one or more gears 136 configured to engage with a gear rack arranged on the rail 128, for example. Engagement between the gears on each engaging mechanism 134 with the pair of rails 128 may allow the bridge 130 to move along the two rails. FIG. 7 shows an engagement mechanism 134 engaging a rail 128 with respect to three different positions of the bridge 130. In some embodiments, a drive motor may drive the bridge's 130 movement along the rails 128. For example, as shown in FIG. 8, a bridge drive motor 138 may be arranged on the bridge 130 itself in some embodiments. As additionally shown in FIG. 8, in some embodiments, the bridge 130 may have a gear rack 140 configured to engage with one or more gears or a gear box of the hoist 132.

With reference to FIGS. 6 and 8, the hoist 132 may be arranged on the bridge 130 and may be configured to provide means for handling sections of drill pipe and generally moving drilling pipe sections to and from mousehole 116, 118 locations to build stands. The hoist 132 may be electrically and/or hydraulically controlled. The hoist 132 may have a hoist trolley 142 configured to move back and forth along the bridge 130. In some embodiments, the hoist trolley 142 may have one or more roller wheels, such as four or two roller wheels, for moving along the bridge 130. Additionally or alternatively, the hoist trolley 142 may have one or more gears configured to engage with the gear rack 140 on the bridge 130. A drive motor may drive the hoist's 132 movement along the bridge 130. For example, a hoist drive motor 144 may be arranged on the hoist trolley 142 in some embodiments, and may drive movement of the one or more gears. The hoist 132 may generally have a wireline that extends toward the drill floor 104. The wireline may extend from the rail system 126 and toward the drill floor 104. In some embodiments, a pipe elevator or lifting sling may be arranged at an end of the wireline for latching onto and moving pipe sections. In some embodiments, the hoist 132 may have a pipe elevator or lifting sling with multiple pipe attachments, such that more than one pipe section may be handled by the hoist simultaneously. In some embodiments, the multi-pipe elevator or sling may have spacing configured to align with the offline mouseholes 116, such that, for example, two pipes may be simultaneously hoisted and inserted into the mouseholes 116*a*, 116*b*.

In use, a drill rig 100 of the present disclosure may provide for efficient drill pipe standbuilding operations. In some embodiments, a drill rig 100 of the present disclosure may provide for offline drill pipe standbuilding independent of at least some drilling operations. In particular, apparatuses, systems, and methods of the present disclosure may provide for double and/or triple standbuilding operations, for example, without interrupting drilling operations. Drill pipe stands may be constructed using the offline mouseholes 116 and the rail system 126, such that the standbuilding may be performed independent of, and in some embodiments simultaneously with, drilling operations at the well center 110.

A drill pipe stand of the present disclosure may be a double or triple stand, for example. In other embodiments, longer stands are contemplated as well. Each section of drill pipe may have a length of between approximately 15 and 60 feet in some embodiments. Particularly, each section of drill pipe may have a length of between approximately 20 and 55 feet. More particularly, each section of drill pipe may have a length of between approximately 25 and 50 feet in some embodiments. In particular embodiments, some drill pipe sections may have a length of approximately 30 or 31 feet, for example. In another particular embodiments, some drill pipe sections may have a length of approximately 45 feet. The drill pipe sections may be coupled together to form stands of two or more sections. That is, drill pipe sections having a length of approximately 31 feet may form a double stand of approximately 62 feet or a triple stand of approximately 93 feet. Similarly, drill pipe sections having a length of approximately 45 feet may form a double stand of approximately 90 feet. In some embodiments, drill pipe sections of different lengths may be joined together to form stands having different lengths. The drill pipe sections may be coupled together using any suitable coupling means. For example, in some embodiments, each drill pipe section may have a male end with outer threading and a female end with inner threading. The outer threading of one pipe section may be configured to engage with the inner threading of another pipe section, such that the two pipe sections may be screwed together.

Figure 10:
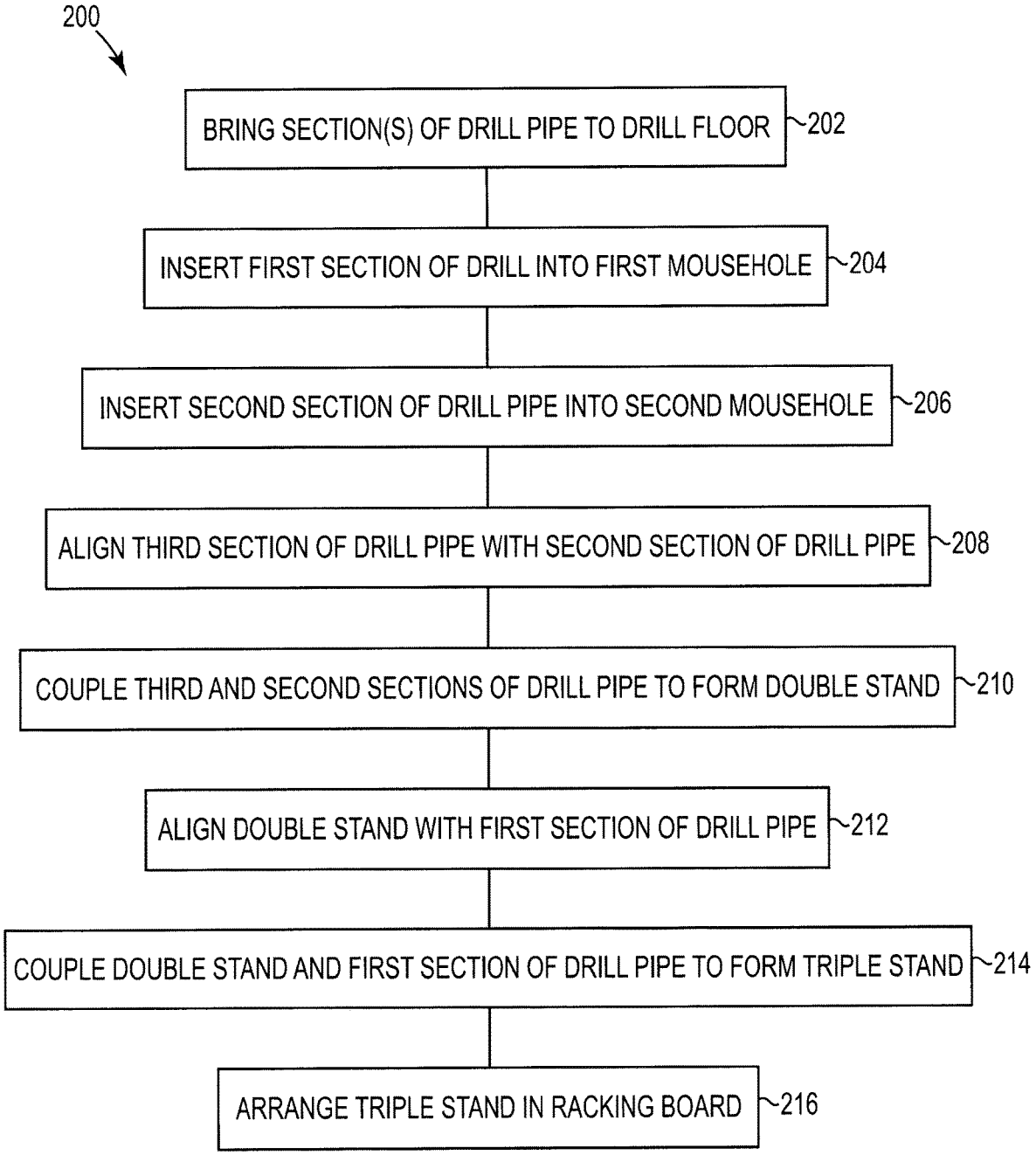
FIG. 10 is a flow diagram of a method of the present disclosure for building a triple drill pipe stand, according to one or more embodiments.

FIG. 10 illustrates a standbuilding method 200 of the present disclosure, according to some embodiments. The method 200 may include bringing one or more sections of pipe to the drill floor 202; inserting a first section of pipe into a first mousehole 204; inserting a section of pipe into a second mousehole 206; aligning a third section of pipe with the second section of pipe 208; coupling the third and second sections of pipe to create a double stand 210; aligning the double stand with the first section of drill pipe 212; coupling the double stand with the first section of pipe to create a triple stand 214; and arranging the triple stand in the racking board 216.

As mentioned, the method 200 may generally include bringing sections of pipe to the drill floor 104. (202) In some embodiments, the sections may be brought up to the drill floor 104 through the V-door 112 and ramp or pipe machine 114. In other embodiments, the sections may be brought to the drill floor 104 by way of tugger/utility winch(es), and/or any other suitable lifting or handling means. Sections of pipe may be brought to the drill floor 104 individually. That is, for example, each section of drill pipe may be brought to the drill floor 104 just prior to being used to build the stand. In other embodiments, multiple pipes may be brought to the drill floor 104. For example, where a triple stand is to be built, three sections of drill pipe may be brought to the drill floor 104 prior to beginning building the stand. In some embodiments, each section of drill pipe may be brought to the drill floor 104 in line with the well center 110 and between the middle of the setback floor.

Figure 11A:
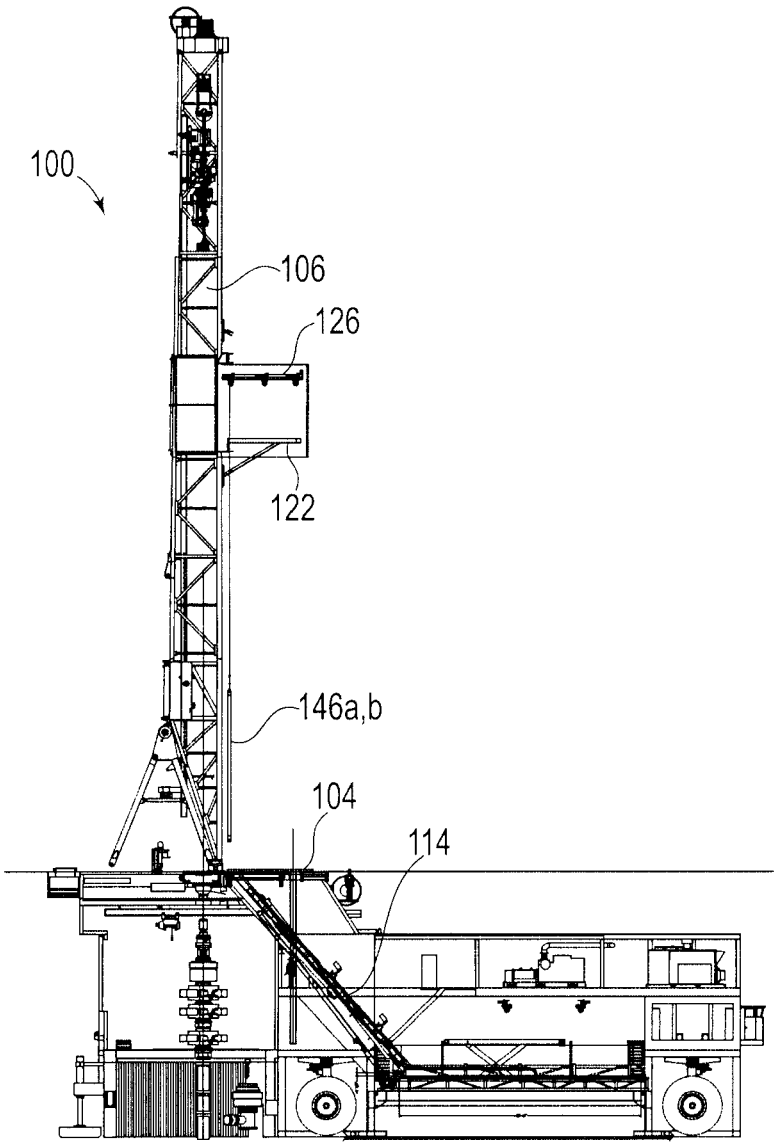
FIG. 11A is a side view of a drill rig of the present disclosure, with first and second drill pipe sections hoisted by a rail system, according to one or more embodiments.
Figure 11B:
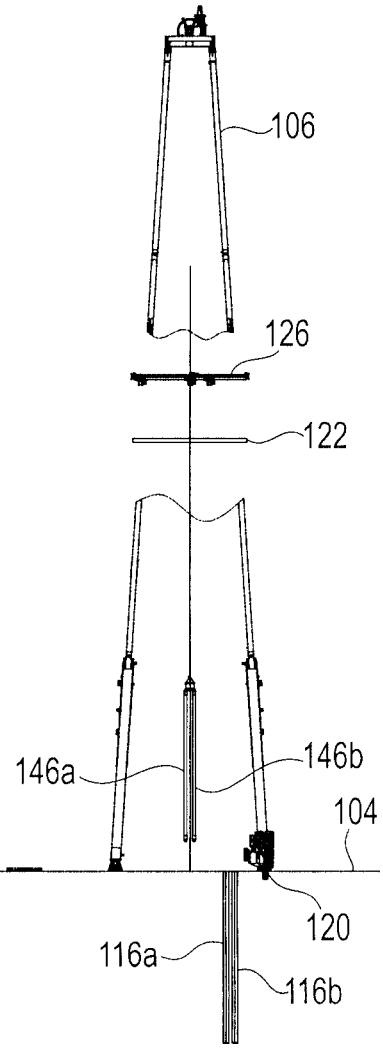
FIG. 11B is a schematic front view of the drill rig of FIG. 11A, according to one or more embodiments.

Of the pipe sections brought to the drill floor 104, a first section of pipe may be inserted into a first offline mousehole 116*a*. (204) Looking for example at FIGS. 11A and 11B, in some embodiments, the hoist 132 may operate to couple with or grab the first section of drill pipe 146*a* via a sling or pipe elevator. The hydraulically or electrically operated hoist 132 may retract to draw the first section of pipe 146*a* off of the floor 104. The first section of drill pipe 146*a* may thus be supported by the hoist 132. The hoist 132 may move along the bridge 130, and the bridge may additionally move along the rails 128 to bring the first section of drill pipe 146*a* toward the first mousehole 116*a*. The hoist 132 may operate to lower the drill pipe 146*a* into the first mousehole 116*a*. When the first section of drill pipe 146*a* is arranged in the first mousehole 116*a*, approximately a few feet of the drill pipe may remain extended above the drill floor 104 in some embodiments, as described above. Where the drill pipe 146*a* has threaded ends, the first section of drill pipe may be inserted into the mousehole 116*a* such that an end of the pipe having inner threading is exposed above the mousehole. In some embodiments, a set of drill pipe slips, or another stabilizing or wedging tool, may be arranged in the mousehole 116*a* to secure the drill pipe 146*a* in position in the mousehole. The sling or pipe elevator may be disconnected from the first section of drill pipe 146*a* once the pipe is arranged in the first mousehole 116*a*.

Figure 12A:
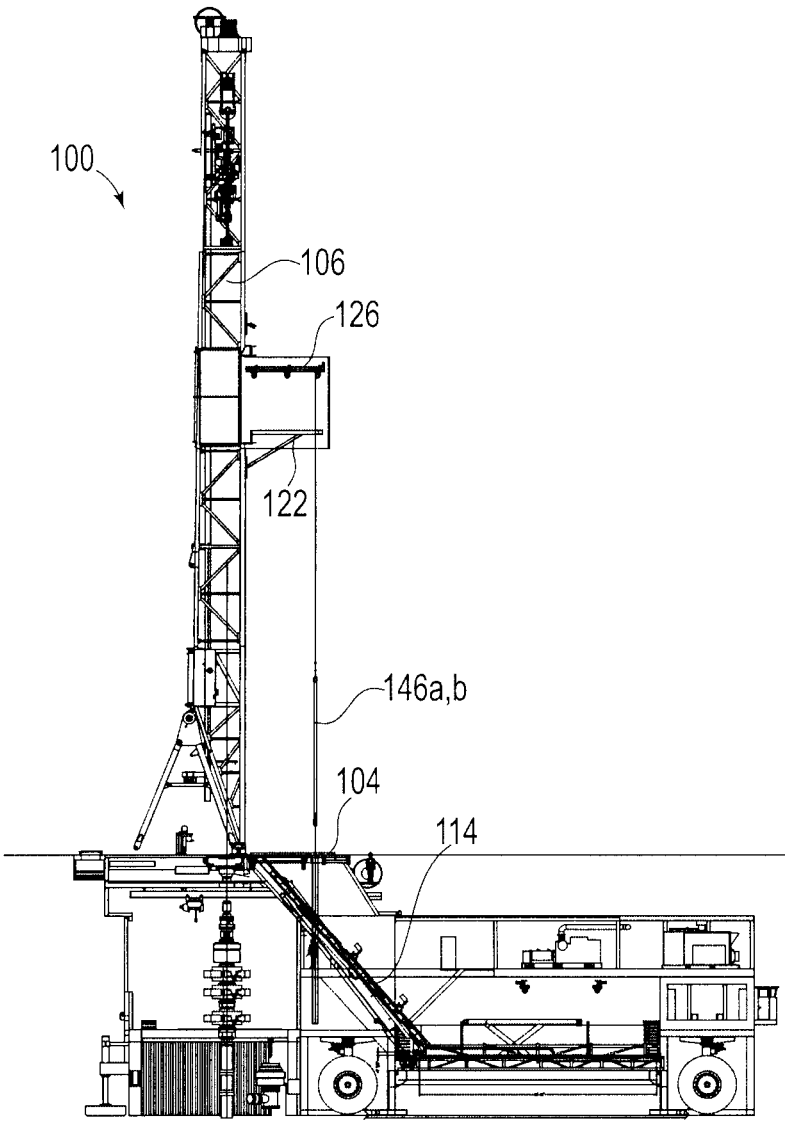
FIG. 12A is a side view of a drill rig of the present disclosure, with first and second drill pipe sections inserted into first and second mouseholes, according to one or more embodiments.
Figure 12B:
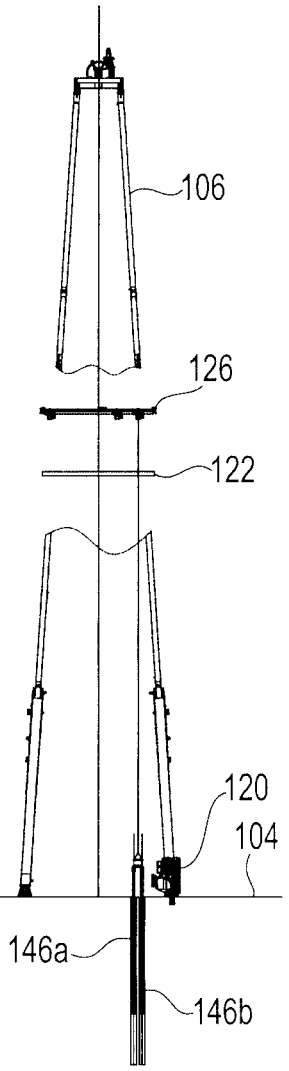
FIG. 12B is a schematic front view of the drill rig of FIG. 12A, according to one or more embodiments.

The hoist 132 may move along the bridge 130, and the bridge may move along the pair of rails 128 to reach a second section of drill pipe 146*b*, which may be arranged on the drill floor 104 near the well center 110, for example. (206) The second section of pipe 146*b* may be transported to and inserted into a second mousehole 116*b*, similarly to the first section of pipe 146*a* in the first mousehole 116*a*. As shown for example in FIGS. 11A and 11B, in some embodiments, the first and second sections 146*a*, 146*b* of drill pipe may be simultaneously hoisted from the drill floor 104 using the hoist 132. That is, where the hoist 132 may have a pipe elevator or sling configured to lift more than one pipe section, the first and second pipe sections 146*a*, 146*b* may be simultaneously lifted and placed in the first and second mouseholes 116*a*, 116*b*, as further shown in FIGS. 12A and 12B. It may be appreciated that the pipe elevator or sling may be configured to space the two pipe sections to match the spacing of the two mouseholes 116*a*, 116*b*.

Figure 13A:
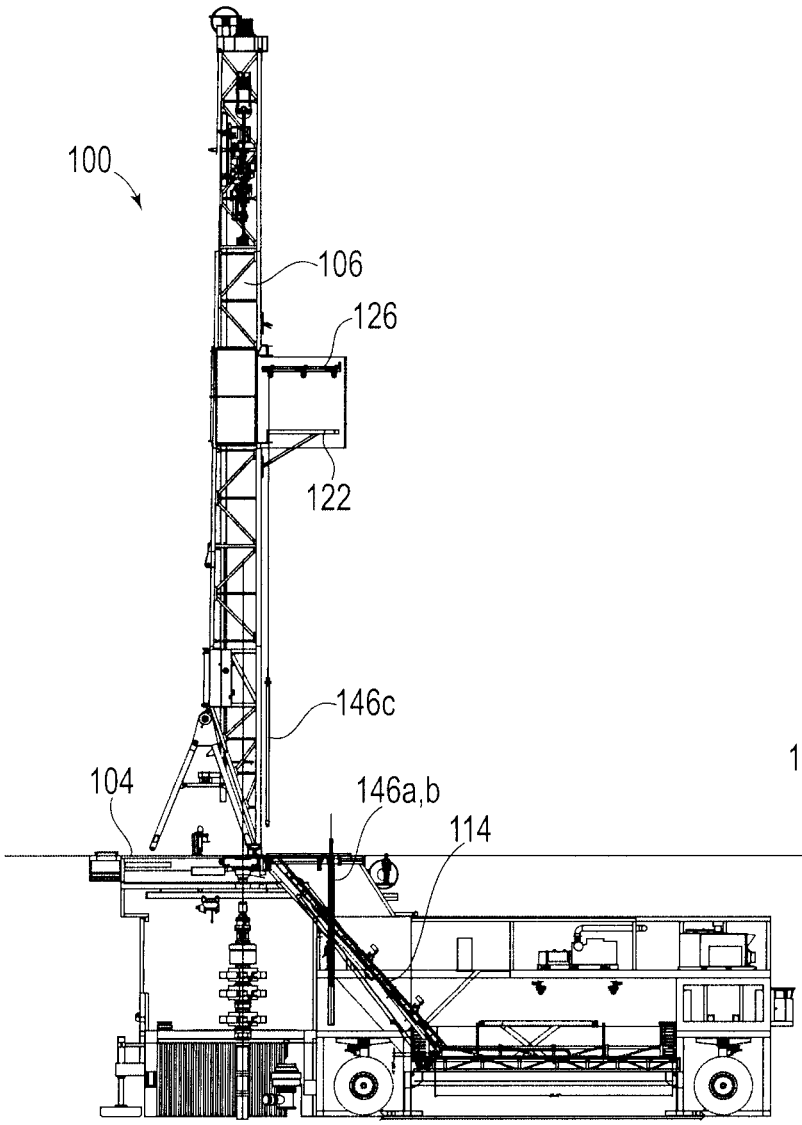
FIG. 13A is a side view of a drill rig of the present disclosure, with a third drill pipe section hoisted by a rail system, according to one or more embodiments.
Figure 13B:
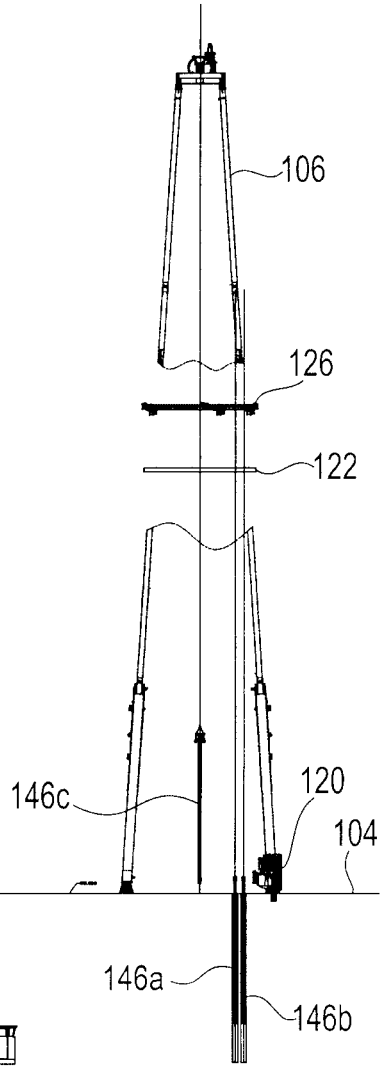
FIG. 13B is a schematic front view of the drill rig of FIG. 13A, according to one or more embodiments.

The method 200 may include aligning a third section of drill pipe with the second section of drill pipe 146*b* in the second mousehole 116*b*. (208) As shown for example in FIGS. 13A and 13B, the third section of drill pipe 146*c* may be hoisted from its location on the drill floor 104 using the hoist 132. The hoist 132 may move along the bridge 130, and the bridge may move along the rails 128 to align the third section of drill pipe 146*c* with the second section of drill pipe 146*b*. The hoist 132 may lower the third section of pipe 146*c* toward the second section 146*b*, until threading of the two sections aligns. For example, where the third section of drill pipe 146*c* has outer threading, and the second section of pipe 146*b* has inner threading, the third section may be lowered toward the second section until the third section fits within the second section in order to align the inner and outer threading of the two sections. Alternatively, in some embodiments, the third section 146*c* may be aligned with the first section 146*a*.

Figure 14A:
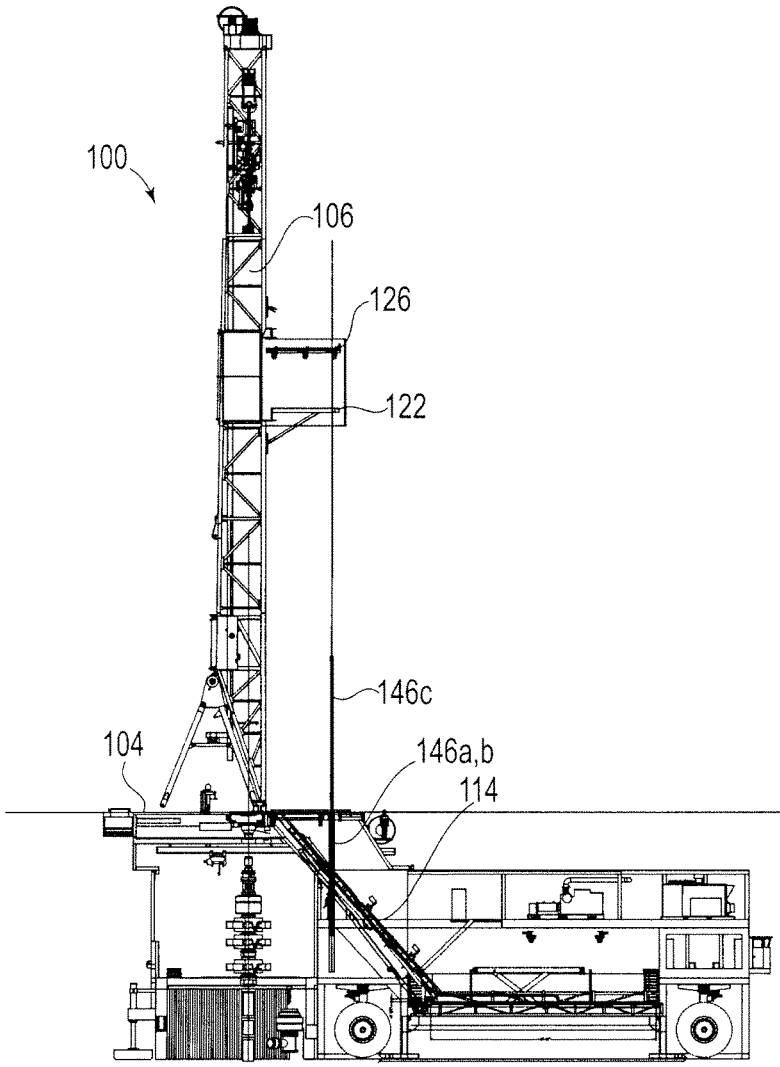
FIG. 14A is a side view of a drill rig of the present disclosure, with a third drill pipe section aligned with a second drill pipe section over a second mousehole, according to one or more embodiments.
Figure 14B:
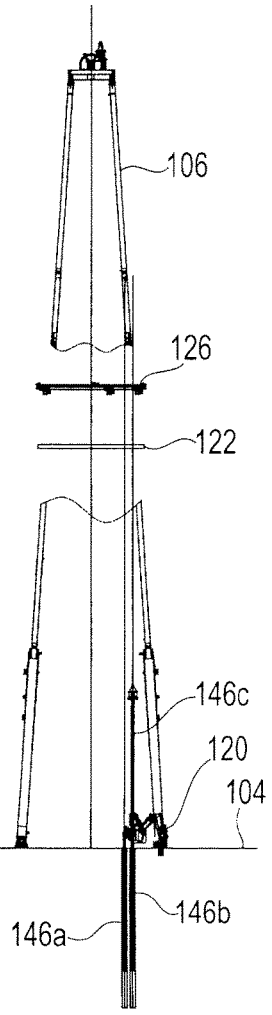
FIG. 14B is a schematic front view of the drill rig of FIG. 14A, according to one or more embodiments.
Figure 15:
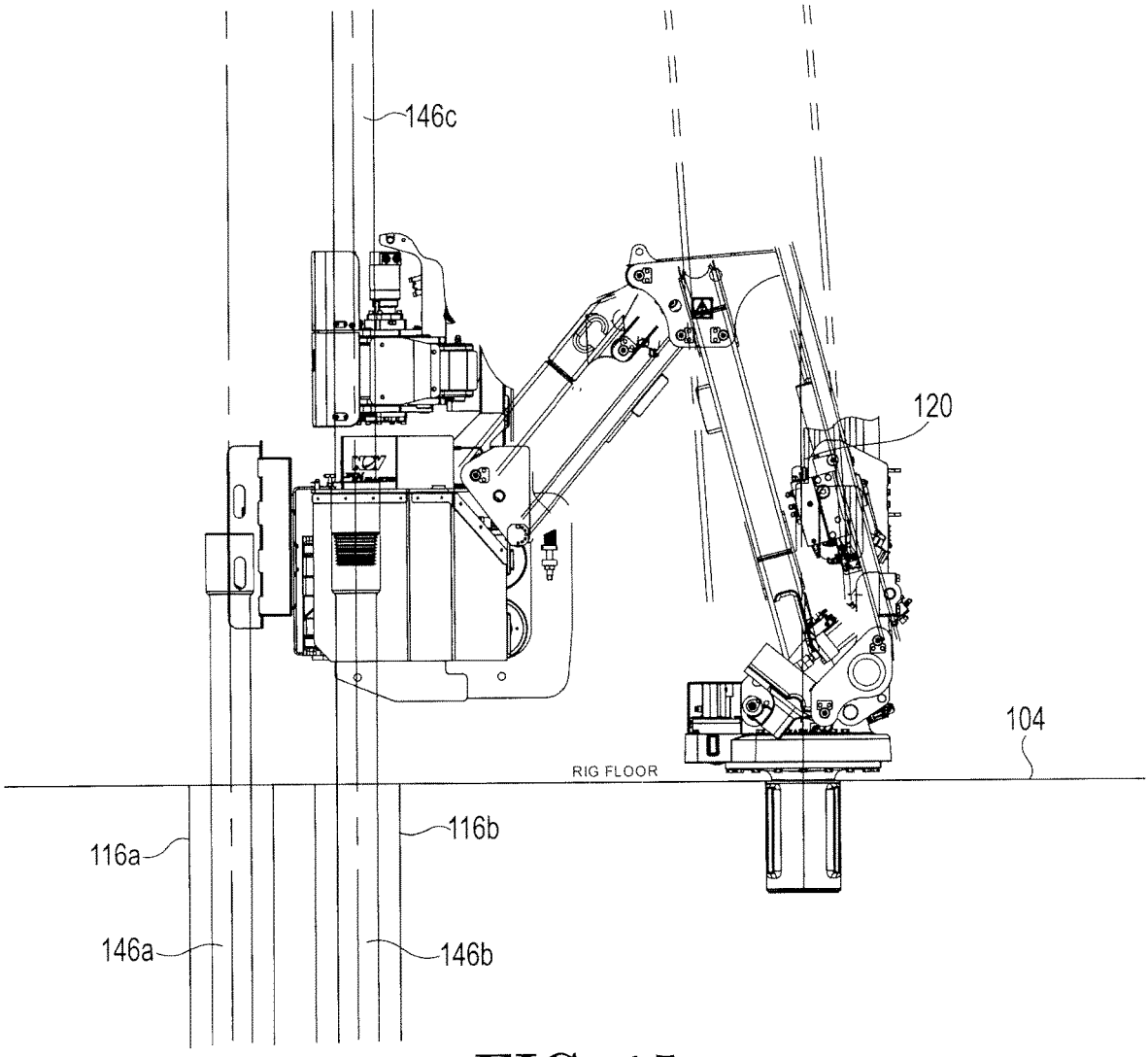
FIG. 15 is a side view of an iron roughneck extending to a second mousehole to couple together second and third drill pipe sections, according to one or more embodiments.

Once aligned, the third section 146*c* and second section 146*b* of pipe may be coupled together to form a double stand of drill pipe. (210) For example, as described above, the two sections of pipe 146*b*, 146*c* may have threading, and may thus be screwed together. In some embodiments, as shown for example in FIGS. 14A and 14B, an iron roughneck 120 may extend toward the second mousehole 116*b* to couple the two sections of pipe 146*b*, 146*c* together. This iron roughneck operation is additionally shown in FIG. 15. The iron roughneck 120 may spin/screw the two pipe sections 146*b*, 146*c* together, and generally apply an amount of torque sufficient to make up the connection between the two pipe sections. In other embodiments, the two sections of drill pipe 146*b*, 146*c* may be coupled together using other suitable coupling mechanisms and operations. In some embodiments, the hoist 132 may remain connected to the third section of drill pipe 146*c* while the third section and second section 146*b* are coupled together.

Figure 16A:
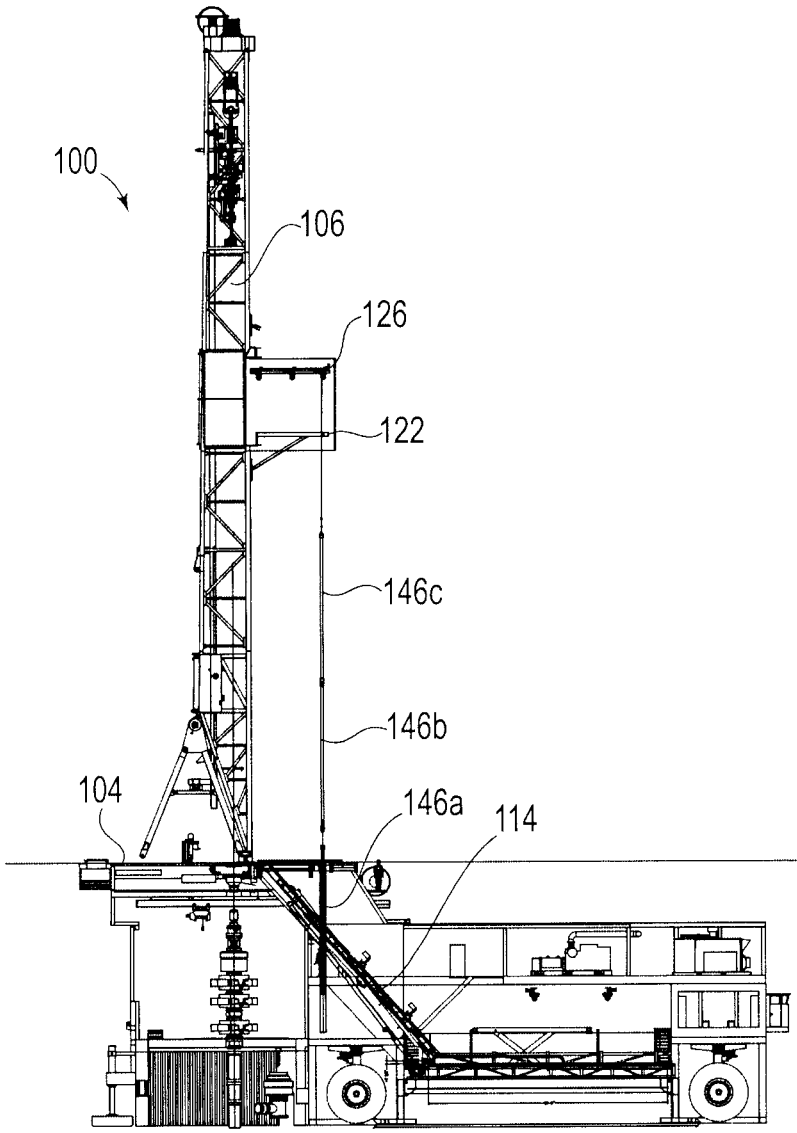
FIG. 16A is a side view of a drill rig of the present disclosure, with second and third drill pipe sections aligned with a first drill pipe section over a first mousehole, according to one or more embodiments.
Figure 16B:
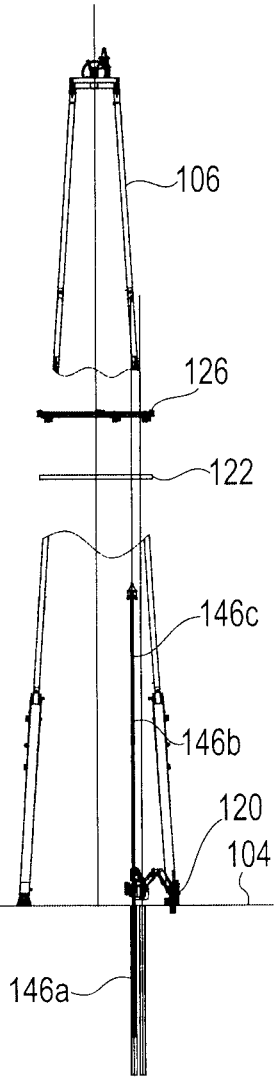
FIG. 16B is a schematic front view of the drill rig of FIG. 16A, according to one or more embodiments.

The hoist 132 may operate to align the double stand of drill pipe with the first section of drill pipe 146*a* arranged in the first mousehole 116*a*, as shown for example in FIGS. 16A and 16B. (212) In this way, the hoist 132 may retract to pull the double stand out of the second mousehole 116*b*, and the hoist may move along the bridge 130 and/or the bridge may move along the rails 128 to align the double stand over the first section of drill pipe 146*a* in the first mousehole 116*a*. The hoist 132 may lower the double stand toward the first section of drill pipe 146*a*. For example, as described above, the hoist 132 may lower the double stand toward the first section of drill pipe 146*a* to align threading on the first and second sections 146*b* of drill pipe.

Figure 17:
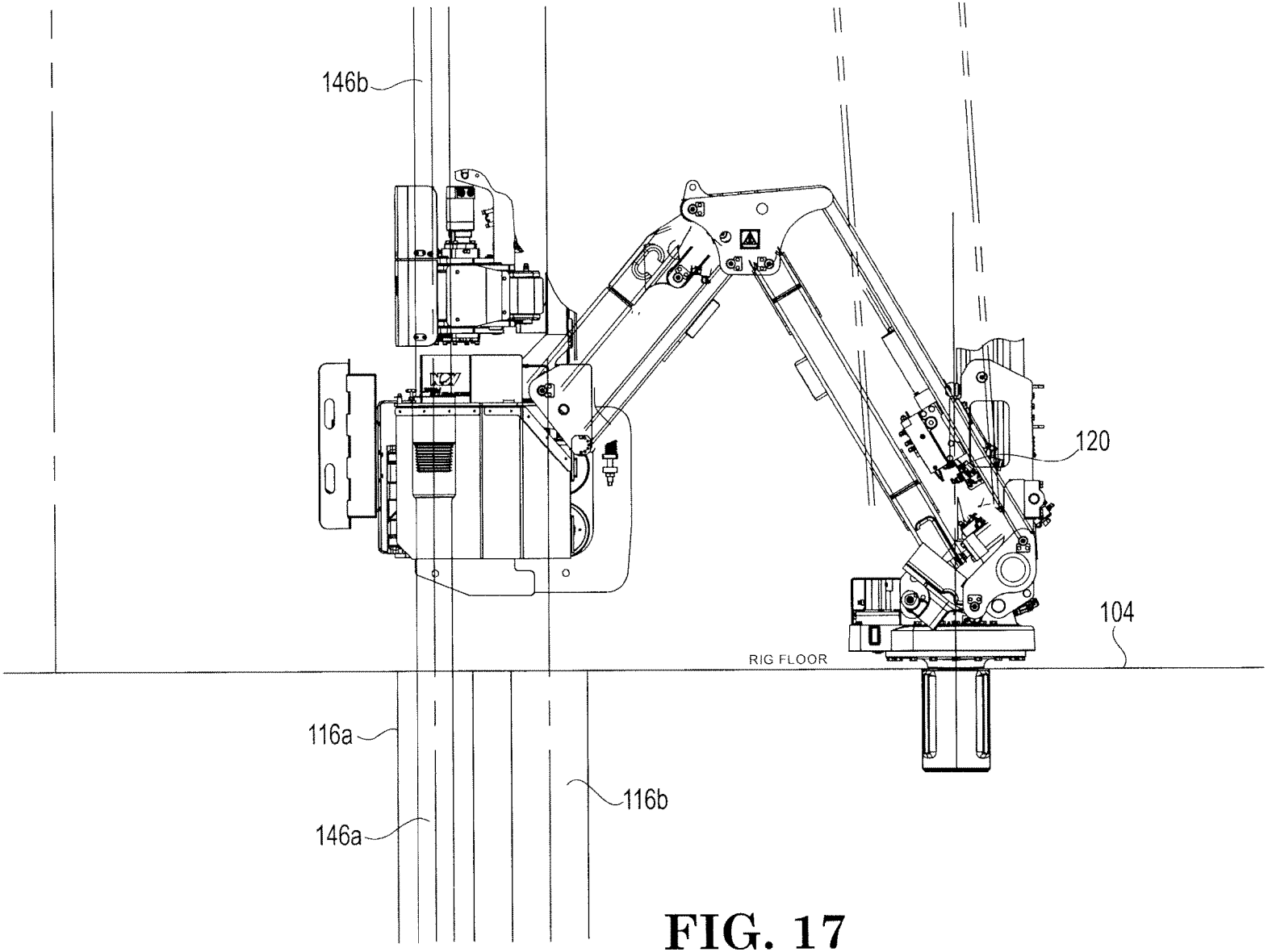
FIG. 17 is a side view of an iron roughneck extending to a first mousehole to couple together first and second drill pipe sections, according to one or more embodiments.

Once aligned, the double stand and the first section of drill pipe 146*a* may be coupled together to form a triple stand of drill pipe. (214) For example, as described above, the two pipes 146*a*, 146*b* may have threading and may be threaded together using an iron roughneck 120. As shown for example in FIG. 17, the iron roughneck 120 may extend toward the first mousehole 116*a* to screw the double stand and first drill pipe section 146*a* together. In other embodiments, the double stand and first section of drill pipe 146*a* may be coupled together using any other suitable coupling mechanisms and operations. In some embodiments, the hoist 132 may remain connected to the third section of drill pipe 146*c* while the second 146*b* and first 146*a* sections are coupled together.

Figure 18A:
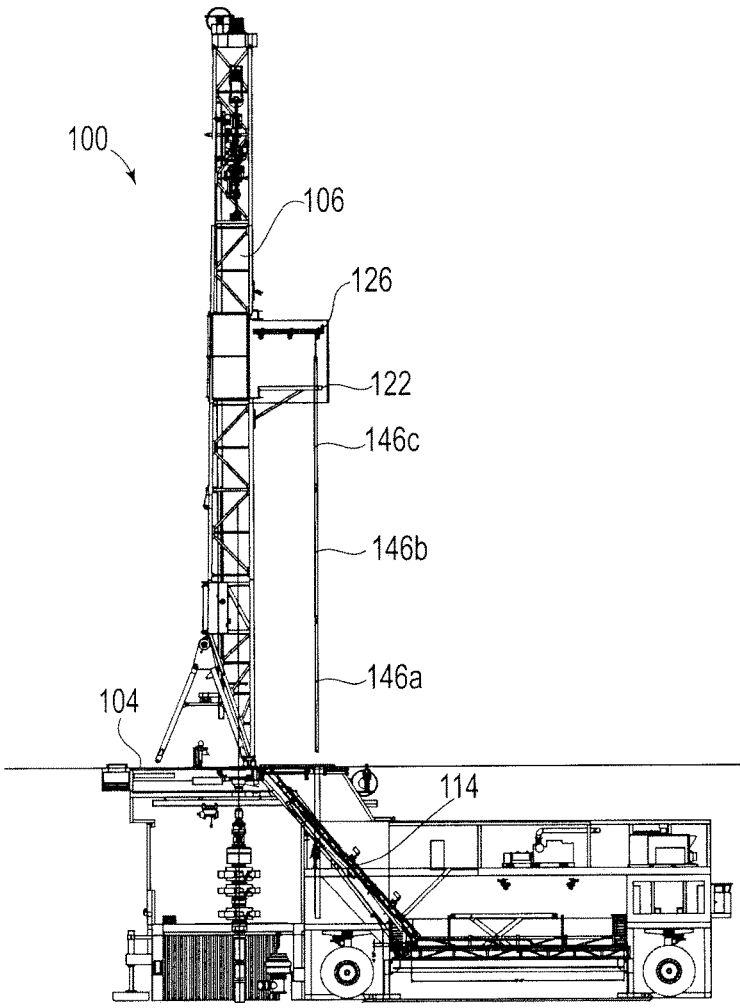
FIG. 18A is a side view of a drill rig of the present disclosure, with a triple stand hoisted by the rail system, according to one or more embodiments.
Figure 18B:
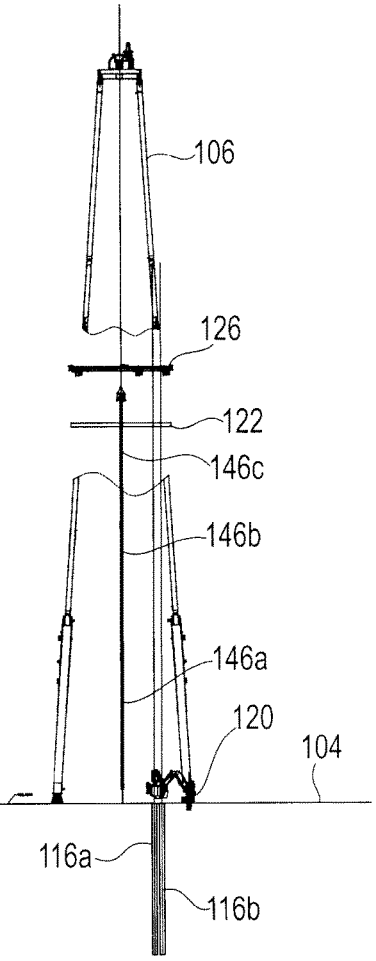
FIG. 18B is a schematic front view of the drill rig of FIG. 18A, according to one or more embodiments.

The hoist 132 may operate to bring the triple stand to the racking board 122 in some embodiments. (216) That is, the hoist 132 may retract to pull the triple stand out of the first mousehole 116*a* and up to the racking board 122, as shown for example in FIGS. 18A and 18B. The hoist 132 may move along the bridge 130 and/or the bridge may move along the rails 128 to position the triple stand in the racking board 122. In other embodiments, the hoist 132 may place the triple stand in a different location to otherwise make the triple stand available to the top drive for drilling operations.

It may be appreciated that, in some embodiments, double stands may be built instead of or in addition to triple stands. For example, a single mousehole may be used to build a double stand of drill pipe, which may be placed in the racking board or otherwise made available to the top drive for drilling operations. A method of building a double stand using a drill rig of the present disclosure would generally include the steps of bringing sections of drill pipe to the drill floor; inserting a first section of drill pipe into the mousehole; aligning a second section of drill pipe with the first section of drill pipe in the mousehole; coupling the first and second sections of drill pipe together to form the double stand; and arranging the double stand in the racking board. The steps may be similar to those described above with respect to the method 200.

It is to be appreciated that the apparatuses, systems, and methods of the present disclosure may provide for standbuilding operations that are agnostic to drilling operations and drilling equipment. In this way, the standbuilding operations described herein may be performed offline with respect to drilling operations, and may thus occur simultaneously with drilling operations. This may help to improve the overall efficiency of the drill rig, by providing double and/or triple drill standbuilding without delaying drilling operations. Moreover, the apparatuses, systems, and methods described herein may be suitable for both offshore and onshore rigs. For example, by arranging a rail system above the racking board, and allowing the hoist to operate through the racking board to reach the offline mouseholes, the apparatuses, systems, and methods described herein may be compatible with the relative space constraints of some onshore rigs. It may further be appreciated that apparatuses, systems, and methods of the present disclosure, including offline mouseholes and a hoist and rail system may additionally be used to disassemble a drill string in some embodiments and/or disassemble one or more drill pipe stands.

Various embodiments of the present disclosure may be described herein with reference to flowchart illustrations and/or block diagrams of methods, apparatus (systems), and computer program products. Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A drill rig comprising:

a drill floor for performing drilling operations and having a longitudinal centerline extending through a setback area and across well center defining a driller side and an off-driller side;

a mast having a racking board adjacent the mast and extending laterally away from the mast;

a mousehole arranged at or near well center; and an offline standbuilding system for building drill pipe stands without interrupting drilling operations; the system comprising:

a first offline mousehole arranged in the setback area of the drill floor and on the off-driller side of the drill floor;

a second offline mousehole arranged adjacent the first offline mousehole, the second offline mousehole being arranged in the setback area and on the off-driller side of the drill floor; and a rail system arranged above and extending across a top of the racking board, the rail system comprising:

a pair of rails spaced apart from one another and extending laterally away from the mast;

a bridge spanning between and operably coupled to the pair of rails and moveable along the pair of rails laterally toward and away from the mast across the top of the racking board;

a hoist trolley operably coupled to the bridge and configured to move back and forth along the bridge; and a hoist supported by the bridge via the hoist trolley and configured for handling sections of drill pipe;

wherein, the pair of rails have a length allowing the bridge to be aligned above the first and second offline mouseholes.

2. The drill rig of claim 1, further comprising a racking board frame sized and arranged to allow the hoist to operate inside the racking board frame.

3. The drill rig of claim 1, wherein the hoist comprises a hydraulic hoist or an electric hoist.

4. The drill rig of claim 1, wherein the hoist comprises a wireline and a pipe sling or pipe elevator.

5. The drill rig of claim 4, wherein the pipe sling or pipe elevator is configured to hoist two drill pipe sections simultaneously.

6. The drill rig of claim 1, further comprising an iron roughneck arranged on the drill floor for coupling drill pipe sections together to form drill pipe stands.

7. An offline standbuilding system for building drill pipe stands on a drill floor without interrupting drilling operations, the drill floor having a longitudinal centerline extending through a setback area and across well center and defining a driller side and an off driller side, the system comprising:

a first offline mousehole arranged in the setback area of the drill floor and on the off-driller side of the drill floor;

a second offline mousehole arranged adjacent the first offline mousehole, the second offline mousehole being arranged in the setback area and on the off-driller side of the drill floor; and a rail system arranged above and extending across a top of a racking board, the racking board being arranged adjacent to and extending laterally away from a mast on the drill rig, the rail system comprising:

a pair of rails spaced apart from one another and extending laterally away from the mast;

a bridge spanning between and operably coupled to the pair of rails and moveable along the pair of rails laterally toward and away from the mast across the top of the racking board;

a hoist trolley operably coupled to the bridge and configured to move back and forth along the bridge; and a hoist supported by the bridge via the hoist trolley and configured for handling sections of drill pipe, wherein, the pair of rails have a length allowing the bridge to be aligned above the first and second offline mouseholes.

8. The offline standbuilding system of claim 7, wherein the hoist comprises a wireline and a pipe sling or pipe elevator.

9. The offline standbuilding system of claim 7, further comprising an iron roughneck for coupling drill pipe sections together to form drill pipe stands.

* * * * *